US009091055B2

(12) United States Patent
Jensen

(10) Patent No.: US 9,091,055 B2
(45) **Date of Patent: *Jul. 28, 2015**

(54) WALL ASSEMBLY METHOD

(71) Applicant: David Jensen, Santa Rosa, CA (US)

(72) Inventor: David Jensen, Santa Rosa, CA (US)

(73) Assignee: Sonoma Cast Stone Corporation, Petaluma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/689,474

(22) Filed: Nov. 29, 2012

(65) Prior Publication Data

US 2013/0081353 A1 Apr. 4, 2013

Related U.S. Application Data

(63) Continuation-in-part of application No. 13/231,859, filed on Sep. 13, 2011, which is a continuation-in-part of application No. 12/544,028, filed on Aug. 19, 2009, now Pat. No. 8,015,772.

(60) Provisional application No. 61/090,113, filed on Aug. 19, 2008.

(51) Int. Cl.

| | |
|---|---|
| ***E04B 2/40*** | (2006.01) |
| ***E04B 2/44*** | (2006.01) |
| ***E04B 2/54*** | (2006.01) |
| ***E04B 2/86*** | (2006.01) |
| *E04B 2/02* | (2006.01) |

(52) U.S. Cl.

CPC ... *E04B 2/40* (2013.01); *E04B 2/44* (2013.01); *E04B 2/54* (2013.01); *E04B 2/8652* (2013.01); *E04B 2002/0206* (2013.01)

(58) Field of Classification Search

CPC ..... E04B 2/40; E04B 2/44; E04B 2/54; E04B 2/8652; E04B 2002/0206

USPC ..... 52/574, 503, 419, 422, 424, 432, 561, 52/608, 609, 438, 479, 483.1, 562, 565, 52/568, 571, 572, 604, 607, 426, 742.1, 52/747.12; 405/284, 286, 262

See application file for complete search history.

(56) References Cited

U.S. PATENT DOCUMENTS

| | | | | |
|---|---|---|---|---|
| 1,990,797 A * | 2/1935 | Olsen | ..... | 52/429 |
| 2,029,082 A * | 1/1936 | Odam | ..... | 52/275 |

(Continued)

FOREIGN PATENT DOCUMENTS

| | | |
|---|---|---|
| AT | 245208 B | 2/1966 |

*Primary Examiner* — Rodney Mintz

(74) *Attorney, Agent, or Firm* — Craig M. Stainbrook; Stainbrook & Stainbrook, LLP

(57) ABSTRACT

A method of assembling a two-sided wall on, through and around a preinstalled structural grid, the method including the assembly of planar wall units, each having an outer side and an inner side, the inner side opposing an inner side of at least one other planar wall unit on an opposite side of the structural grid. Interlocking features extend through a space in the structural grid and span from at least an inner side of one planar wall unit to the inner side of another planar wall unit on a same course level so as to support and gauge opposing planar wall units with respect to the structural grid. When installed in courses around the structural grid, the wall units and the interlocking elements create a continuous void between planar wall units to enable structural fill material to be poured therein filling the continuous void from the top of the wall to its base.

12 Claims, 21 Drawing Sheets

(56) References Cited

U.S. PATENT DOCUMENTS

| | | | | | |
|---|---|---|---|---|---|
| 2,335,555 | A | * | 11/1943 | Willson | 52/747.12 |
| 2,442,962 | A | * | 6/1948 | Rumble | 249/38 |
| 2,684,589 | A | * | 7/1954 | Perreton | 52/591.2 |
| 3,310,924 | A | * | 3/1967 | Boynton | 52/565 |
| 3,788,020 | A | * | 1/1974 | Gregori | 52/309.12 |
| 4,114,335 | A | | 9/1978 | Carroll | |
| 4,321,779 | A | * | 3/1982 | Kratchmer | 52/425 |
| 4,574,550 | A | * | 3/1986 | Maschhoff | 52/405.3 |
| 4,577,447 | A | * | 3/1986 | Doran | 52/571 |
| 4,631,890 | A | * | 12/1986 | Szombathelyi | 52/570 |
| 4,655,014 | A | | 4/1987 | Krecke | |
| 4,698,947 | A | * | 10/1987 | McKay | 52/309.12 |
| 4,703,602 | A | | 11/1987 | Pardo | |
| 4,706,429 | A | * | 11/1987 | Young | 52/309.12 |
| 4,730,422 | A | * | 3/1988 | Young | 52/105 |
| 4,765,109 | A | * | 8/1988 | Boeshart | 52/426 |
| 4,856,249 | A | * | 8/1989 | Nickerson | 52/405.4 |
| 4,866,891 | A | * | 9/1989 | Young | 52/105 |
| 5,014,480 | A | * | 5/1991 | Guarriello et al. | 52/309.12 |
| 5,123,222 | A | * | 6/1992 | Guarriello et al. | 52/309.12 |
| 5,459,971 | A | * | 10/1995 | Sparkman | 52/426 |
| 5,566,518 | A | * | 10/1996 | Martin et al. | 52/426 |
| 5,570,552 | A | * | 11/1996 | Nehring | 52/426 |
| 5,596,855 | A | * | 1/1997 | Batch | 52/309.11 |
| 5,658,483 | A | * | 8/1997 | Boeshart | 249/191 |
| 5,701,710 | A | * | 12/1997 | Tremelling | 52/426 |
| 5,771,648 | A | * | 6/1998 | Miller et al. | 52/309.7 |
| 5,782,050 | A | * | 7/1998 | Boeshart | 52/426 |
| 5,809,728 | A | * | 9/1998 | Tremelling | 52/426 |
| 5,820,305 | A | | 10/1998 | Taylor et al. | |
| 5,852,907 | A | * | 12/1998 | Tobin et al. | 52/714 |
| 5,890,337 | A | * | 4/1999 | Boeshart | 52/426 |
| 6,279,285 | B1 | * | 8/2001 | Kubica | 52/426 |
| 6,321,496 | B1 | * | 11/2001 | Martin, Jr. | 52/364 |
| 6,321,497 | B1 | * | 11/2001 | Cormier | 52/425 |
| 6,349,520 | B2 | * | 2/2002 | Kubica | 52/426 |
| 6,438,917 | B2 | * | 8/2002 | Kubica | 52/426 |
| 6,443,662 | B1 | * | 9/2002 | Scales et al. | 405/262 |
| 6,536,172 | B1 | | 3/2003 | Amend | |
| 6,615,561 | B2 | * | 9/2003 | MacDonald et al. | 52/606 |
| 6,665,992 | B2 | * | 12/2003 | Hew | 52/562 |
| 6,832,456 | B1 | * | 12/2004 | Bilowol | 52/426 |
| 7,415,805 | B2 | * | 8/2008 | Nickerson | 52/426 |
| 7,762,033 | B2 | * | 7/2010 | Scott et al. | 52/425 |
| 7,765,765 | B1 | * | 8/2010 | Perronne | 52/742.14 |
| 7,827,752 | B2 | * | 11/2010 | Scherrer | 52/426 |
| 8,015,772 | B2 | | 9/2011 | Jensen | |
| 8,074,419 | B1 | * | 12/2011 | Humphress et al. | 52/607 |
| 8,201,376 | B2 | * | 6/2012 | Witcher | 52/565 |
| 8,371,082 | B2 | * | 2/2013 | Hobbs | 52/453 |
| 8,375,677 | B1 | * | 2/2013 | Weiler | 52/745.1 |
| 8,458,981 | B2 | * | 6/2013 | Kohl et al. | 52/684 |
| 8,549,811 | B2 | * | 10/2013 | Dyson | 52/604 |
| 8,707,652 | B2 | * | 4/2014 | Kim et al. | 52/605 |
| 8,720,160 | B1 | * | 5/2014 | Cooper | 52/745.12 |
| 8,820,024 | B1 | * | 9/2014 | Abdullah et al. | 52/605 |
| 2001/0027630 | A1 | * | 10/2001 | Moore et al. | 52/741.13 |
| 2002/0178676 | A1 | * | 12/2002 | Yost et al. | 52/426 |
| 2002/0187010 | A1 | * | 12/2002 | MacDonald et al. | 405/284 |
| 2007/0193165 | A1 | * | 8/2007 | Stokes | 52/404.1 |
| 2007/0245660 | A1 | * | 10/2007 | Scott et al. | 52/438 |
| 2010/0043336 | A1 | * | 2/2010 | Jensen | 52/604 |
| 2010/0251651 | A1 | * | 10/2010 | Mahe et al. | 52/426 |
| 2011/0047921 | A1 | | 3/2011 | Witcher | |
| 2012/0031031 | A1 | * | 2/2012 | Rulon | 52/503 |
| 2012/0060438 | A1 | * | 3/2012 | Jensen | 52/438 |
| 2014/0053493 | A1 | * | 2/2014 | Carey | 52/604 |
| 2014/0250819 | A1 | * | 9/2014 | Abdullah et al. | 52/605 |
| 2014/0298747 | A1 | * | 10/2014 | Castonguay et al. | 52/562 |

* cited by examiner

WALL ASSEMBLY METHOD

RELATED APPLICATIONS

The present application is a continuation-in-part of U.S. application Ser. No. 13/231,859 filed on Sep. 13, 2011 which is in turn a continuation-in-part of U.S. application Ser. No. 12/544,028 filed on Aug. 19, 2009 and issued as U.S. Pat. No. 8,015,772 on Sep. 13, 2011 which claims priority from U.S. Provisional Application Ser. No. 61/090,113 filed on Aug. 19, 2008.

TECHNICAL FIELD

The present invention involves a system for rapidly assembling a two-sided wall on, through and around a preinstalled structural grid. Various connecting elements are provided for supporting opposing wall units enabling one to build a two-sided wall course by course erecting the wall to a pre-determined length and height whereupon voids created during assembly are filled with a structural fill material to complete the wall.

BACKGROUND OF THE INVENTION

In the past, block walls have been constructed of brick, quarried stone and cast or insulating concrete blocks. Because of the high cost of quarried stone, cast blocks have been the materials of choice as they can be constructed of uniform size and shape having cavities which enable them to receive structural steel reinforcements and concrete fill material to complete construction. Stucco or similar glazing materials could be applied to the exterior of the cast blocks to present a finished surface.

Although cast blocks are relatively inexpensive and easy to assemble, they are not without their disadvantages. It is difficult to convert wall units into end corner units. They tend to lack lateral stability and are susceptible to cracking due to chemical and environmental degradation. Changes in temperature can cause cracking and block separation while it is oftentimes difficult to construct curved configurations using such materials. In addition, it is awkward and quite cumbersome to install rebar within cast blocks for the rebar must be positioned one member at a time within the openings or intertesies of the block units and in between courses of block units as they are stacked one on top of another while being tied to a footing or rebar sections earlier installed.

Recognizing these challenges, others have suggested methods and systems for assembling a two-sided wall.

One such approach is that of Liteform Technologies in particular its "Knock-Down ICF Plank System." Another similar approach is that of Quad-Lock Building Systems and Logix, Insulated Concrete Form System. These systems consists of remote plastic connecting brackets placed between polystyrene panel courses. All three of these systems clearly teach subsequent placement of rebar in-between courses in a way similar to the pre-mentioned CMU block. Although these systems would allow for assembly about preinstalled rebar, they do not teach nor would they allow for attaching brackets to preinstalled rebar members and gauging and supporting wall units from the preinstalled rebar elements during assembly. Further more, it is clear that external and subsequent bracing is required to maintain the integrity of the wall units until structural fill material is incorporated within the assembly.

Similar systems are suggested by IntegraSpec, FormTech, NuDura, and Fox Blocks as part of its 1440 Knock-Down series, all of which teach a breakdown assembly comprising a remote or folding bracket and opposing wall panels allowing variable wall thickness and cost savings regarding shipping. In some cases these systems may allow for but do not teach assembly around preinstalled rebar.

It is thus an object of the present invention to provide a method of assembling a two-sided wall while eliminating the drawbacks of the prior art.

It is yet a further object of the present invention to provide a method for constructing a two-sided form wall about a pre-assembled structural grid.

It is yet a further object of the present invention to provide a method for constructing a two-sided form wall, wherein utility lines can be installed to the structural grid prior to the installation of the wall units of the two sided wall It is still a further object of the present invention to provide a method for assembling a two-sided form wall which can be assembled from a single side of the structural grid.

Yet a further object of the present invention is to provide a method for assembling a two-sided form wall wherein the opposing wall units can be gauged from and supported by the pre-assembled structural grid during the assembly process.

Yet a further object of the present invention is to provide a method for assembling a two-sided form wall that minimizes the requirements of subsequent, external bracing during the introduction of structural fill material.

Still a further object of the present invention is to provide a method for assembling a two-sided form wall with wall units that comprise a finished surface whereby one or both exterior surfaces of the completed form wall are finished surfaces having the same or different structural patterns on each side of the wall without requiring any additional post-assembly fabrication steps.

These and further objects will be more readily apparent when considering the following disclosure and appended claims.

SUMMARY OF THE INVENTION

The present invention involves a method of assembling a two-sided wall having a predetermined length, height and width comprising the steps of:

a. erecting a structural grid, the structural grid comprising a plurality of vertically extending reinforcing members and horizontally extending reinforcing members substantially of a predetermined length and height to provide an internal, skeletal structure of the two-sided wall, the structural grid being attached to a plurality of reinforcing members extending vertically from a structural concrete foundation footing; said structural grid can then be lined and braced as needed to be held straight and plumb;

b. providing a plurality of planar wall units and crossover connecting wall units, said crossover connecting wall units each having a medial span of approximately said width and terminal ends, each planar wall unit having substantially planar front and back faces, said front faces being exposed as constituting an exterior portion of said wall and said back faces being directed to the interior of said wall, said planar wall units having perimeter edges for mating with adjacent wall units and with said terminal ends of said crossover connecting wall units such that upon assembly of said two-sided wall, its exterior surface is substantially continuous and planar comprised of the front faces of said planar wall units and terminal ends of said crossover connecting wall units;

c. positioning said crossover connecting wall units to pass through said structural grid at openings between vertical and horizontal members thereof;

d. positioning planar wall units on both sides of said structural grid to mate with the terminal ends of said crossover connecting wall units at said perimeter edges, and repeating said sequence resulting in said wall units being substantially self supporting across said structural grid to thereby complete a first course of wall units;

e. mating planar wall units with crossover connecting wall units and with adjacent planar wall units at said perimeter edges thereof on both sides of said two-sided wall until courses are built of substantially the predetermined length and height resulting in an internal void between opposing planar wall units of said two-sided wall; and f. introducing structural or thermal insulating fill material between the planar wall units to substantially fill said internal void.

The present invention is also directed to a method of assembling a two-sided wall having a predetermined length, width and height, comprising the steps of:

a. erecting a structural grid comprising a plurality of vertically extending reinforcing members and horizontally extending reinforcing members substantially of the predetermined length and height to provide an internal, skeletal structure of the two-sided wall wherein said structural grid is attached to a plurality of reinforcing members extending vertically from a structural concrete foundation footing; said structural grid can then be lined and braced as needed to be held straight and plumb;

b. providing a plurality of planar wall units having generally planar front and back faces with top, bottom and side tongue and groove edges to facilitate planar wall unit to planar wall unit joining on both sides of the two-sided wall wherein said top edge of each wall unit further comprises a combination of both a tongue and groove running side by side for the length of said top edge;

c. positioning a first row of planar wall units on one side of said structural grid;

d. positioning a second row of planar wall units on an opposite side of said structural grid opposed to the first row of wall units;

e. providing a plurality of connecting brackets, said connecting brackets each having a medial span of approximately said width and double tongues at opposing terminal ends of said connecting bracket sized to capture top and bottom edges of the opposing planar wall units, each medial span having a recess for selectively receiving and retaining a member of the structural grid, said double tongues having a top portion extending above said medial span and a bottom portion extending below said medial span, wherein the bottom portion of said double tongue being sized to capture the top edges of opposing planar wall units by fitting within their groove portions of their tongue and groove combination, whereupon the top portion of said double tongue of said connecting brackets being captured by the bottom groove of planar wall units of a subsequent course;

f. placing a plurality of connecting brackets through the structural grid and attaching a plurality of connecting brackets to members of the structural grid within said recesses of the medial spans, subsequently attaching said bottom portions of the double tongues of the connecting brackets to the grooves running the length of said tongue and groove combinations on the top edges of opposing planar wall units of a first course thereof, wherein said planar wall units are gauged from and supported by said structural grid during wall assembly, thereby completing a first course of planar wall units; and g. continuing to build subsequent courses of planar wall units upon lower courses by seating the bottom edge groove of subsequent wall units upon the collective profile of the tongue portion of the wall units tongue and groove combination and the top portion of said double tongue of the connecting brackets of the course below until the courses are substantially of the predetermined length and height, whereby engagement of said connecting brackets to said structural grid members and opposing planar wall units creates a continuous internal void between the planar wall units through which the structural grid extends, thus enabling the placement and containment of structural or thermal insulating fill therein.

The present invention is also directed to a method wherein a starter assembly is provided for leveling and aligning a bottom course of wall units, said method comprising the steps of:

a. providing a plurality of substantially linear alignment channels sized to be captured by terminal end channels of starter brackets and sized to fit within a bottom groove of planar wall units constituting a first course of said two-sided wall;

b. positioning a first row of alignment channels on one side of said structural grid;

c. positioning a second row of alignment channels on the opposite side of said structural grid opposed the first row of alignment channels;

d. providing a plurality of said starter brackets, each starter bracket comprising a medial span between two terminal ends, each terminal end being sized to capture an alignment channel, the medial span of the starter bracket having penetrations for receiving masonry fasteners and a recess to facilitate adjustable placement around vertically extending reinforcing members;

e. placing a plurality of starter brackets on the surface of said concrete foundation footing as to capture a first alignment channel on a first side of the structural grid within a first terminal end;

f. passing said starter bracket through the structural grid and capturing a second and opposing alignment channel on a second side of said structural grid within a second terminal end of said starter bracket; and g. fastening said starter brackets to said structural concrete foundation footing at a predetermined position with masonry fasteners through said medial span penetrations thereby securing opposing alignment channels at said predetermined positions.

h. providing a plurality of substantially planar leveling shims of ascending thickness sized to be used as adjustable spacers between said alignment channels and structural concrete foundation footing; and i. positioning a plurality of said leveling shims as needed between the alignment channels and the surface of the structural concrete foundation footing for adjustment to the alignment channels and starter brackets for securing the starter assembly and subsequent wall unit courses at a level grade.

The present invention is also directed to a method of assembling a two-sided wall having a predetermined length, width and height, comprising the steps of:

a. erecting a structural grid comprising a plurality of vertically extending reinforcing members and horizontally extending reinforcing members substantially of the predetermined length, width and height to provide an internal, skeletal structure of the two-sided wall wherein said structural grid is attached to a plurality of reinforcing members extending vertically from a structural concrete foundation footing, said structural grid being lined and braced as needed to be held straight and plumb;

b. providing a plurality of planar wall units having generally planar front and back faces with top, bottom and side tongue and groove edges to facilitate planar wall to planar wall unit joining on both sides of the two-sided wall wherein said top edge of each planar wall unit further comprises a combination of both a tongue and groove running side by side for the length of said top edge;

c. positioning a first row of planar wall units on one side of said structural grid;

d. positioning a second row of planar wall units on an opposite side of said structural gird opposing the first row of planar wall units;

e. providing a plurality of linear wall channel brackets, said linear wall channel brackets comprising substantially linear I beams comprising a first rail, a medial span and a second rail running parallel to said first rail for the length of the substantially linear wall channel brackets, said first rail having a double tongue extending above and below said medial span and running the substantial length of said wall channel brackets, the bottom portion of said double tongue being sized to capture the top edges of opposing planar wall units by fitting within their groove portions of their tongue and groove combination whereupon the top portion of said double tongue of said wall channel brackets being captured by the bottom groove of planar wall units of a subsequent course, the second rail being characterized as being discontinuous having recesses configured substantially along its length sized to selectively receive and retain end shoulders of interlocking medial brackets, said interlocking medial brackets sized to span the interior of said two-sided wall between opposing wall units to establish said width;

f. placing a first wall channel bracket atop a first row of planar wall units on a first side of said structural grid by seating the lower portion of the double tongue of the first rail of said wall channel bracket in the groove portion of the tongue and groove combination atop planar wall units in a first row whereby said second rail of the first wall channel bracket overhangs said first row of planar wall units on the interior side of said wall; and g. placing a second wall channel bracket on a second row of planar wall units located on the opposite side of said structural grid opposing a previously installed wall channel bracket by seating the lower portion of the double tongue of the first rail of the second wall channel bracket in the groove portion of the tongue and groove combination of the top edge of the second row of planar wall units whereby the second rail of the second wall channel bracket overhangs the second row of planar wall units on their interior sides in an opposing orientation to the first wall channel bracket;

h. providing a plurality of interlocking medial brackets each comprising a horizontally disposed medial span and opposing vertically disposed end shoulders, said end shoulders being configured to fit and interlock within said recesses of said second rails of said opposing linear wall channel brackets;

i. positioning a plurality of interlocking medial brackets by passing them through said structural grid above opposing wall channel brackets;

j. seating said end shoulders of said interlocking medial brackets into said recesses to connect opposing wall channel brackets across said structural grid while securing and aligning the opposing rows of planar wall units on both sides of said two-sided wall; and k. continuing to construct subsequent courses of planar wall units upon lower planar wall units by seating the bottom edge groove of subsequent planar wall units atop the collective tongue profile of the top edge of previously applied planar wall channel brackets and the tongue portion of the top edge of previously applied planar wall unit tongue and groove combinations to erect a wall of said predetermined length and height whereby engagement of said interlocking brackets to opposing wall channel brackets creates a continuous internal void between wall units through which said structural grid extends, thus enabling placement and containment of structural or insulating fill therein

DETAILED DESCRIPTION OF THE INVENTION

Figure 1:
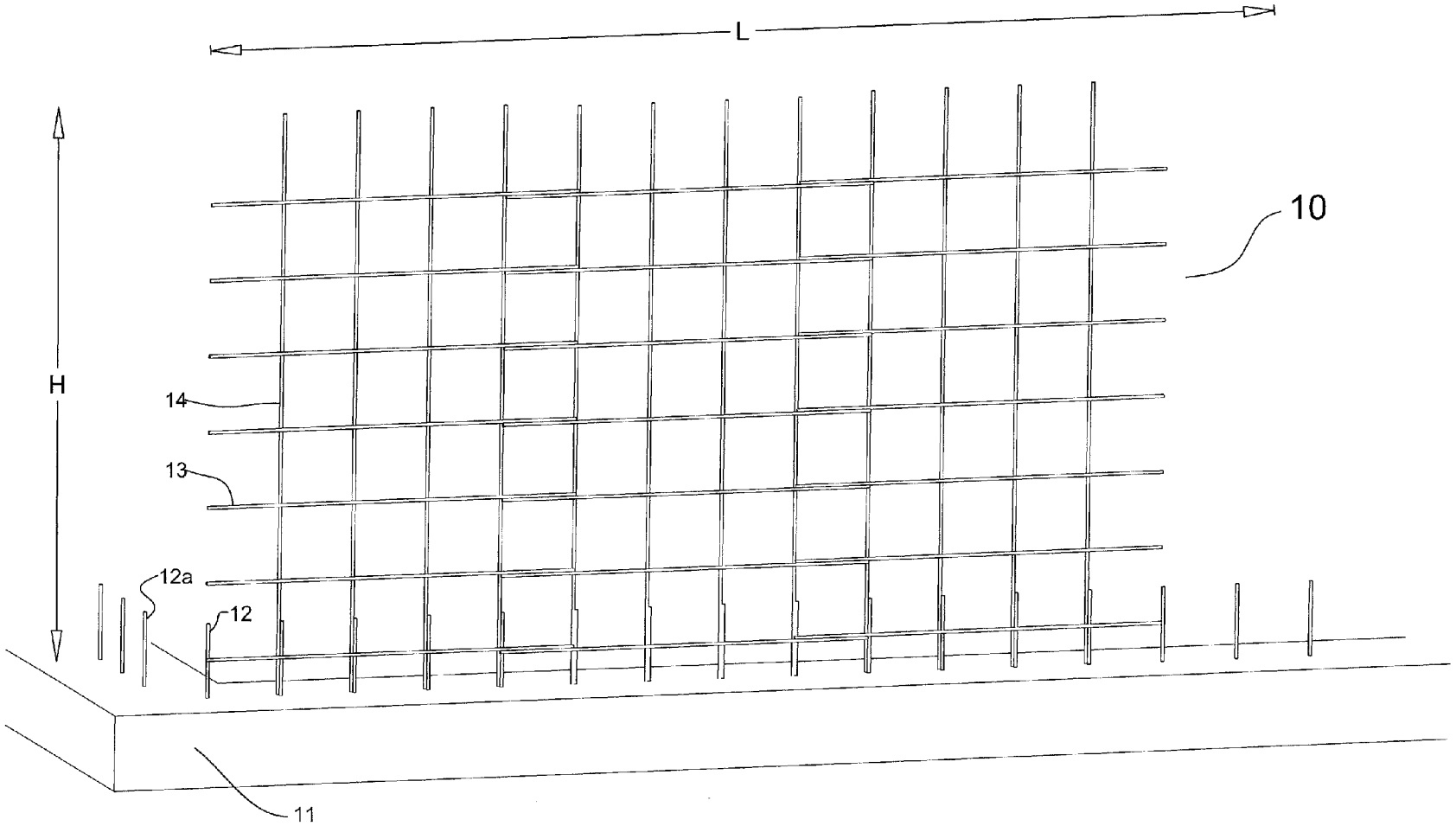
FIG. 1 is a front perspective view of a typical structural grid employed as a starting point in carrying out the present assembly method.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

As noted, the present method is directed to assembling a two-sided form wall having a predetermined length, height and width. In carrying this method, one begins by erecting structural grid 10 of FIG. 1 having length "L" and height "H" composed of a plurality of vertically extending grid members 14 and horizontally extending grid members 13 to provide the skeletal structure of the two-sided wall.

Structural grid assembly 10 is attached to a plurality of reinforcing members 12 extending vertically from a structural concrete foundation footing 11. Although FIG. 1 only depicts a single row of vertically extending grid members 14 and horizontally extending grid members 13, it should be understood that these members can extend in a third dimension as suggested by the inclusion of reinforcing members 12*a* extending from structural concrete foundation footing 11.

Figure 2:
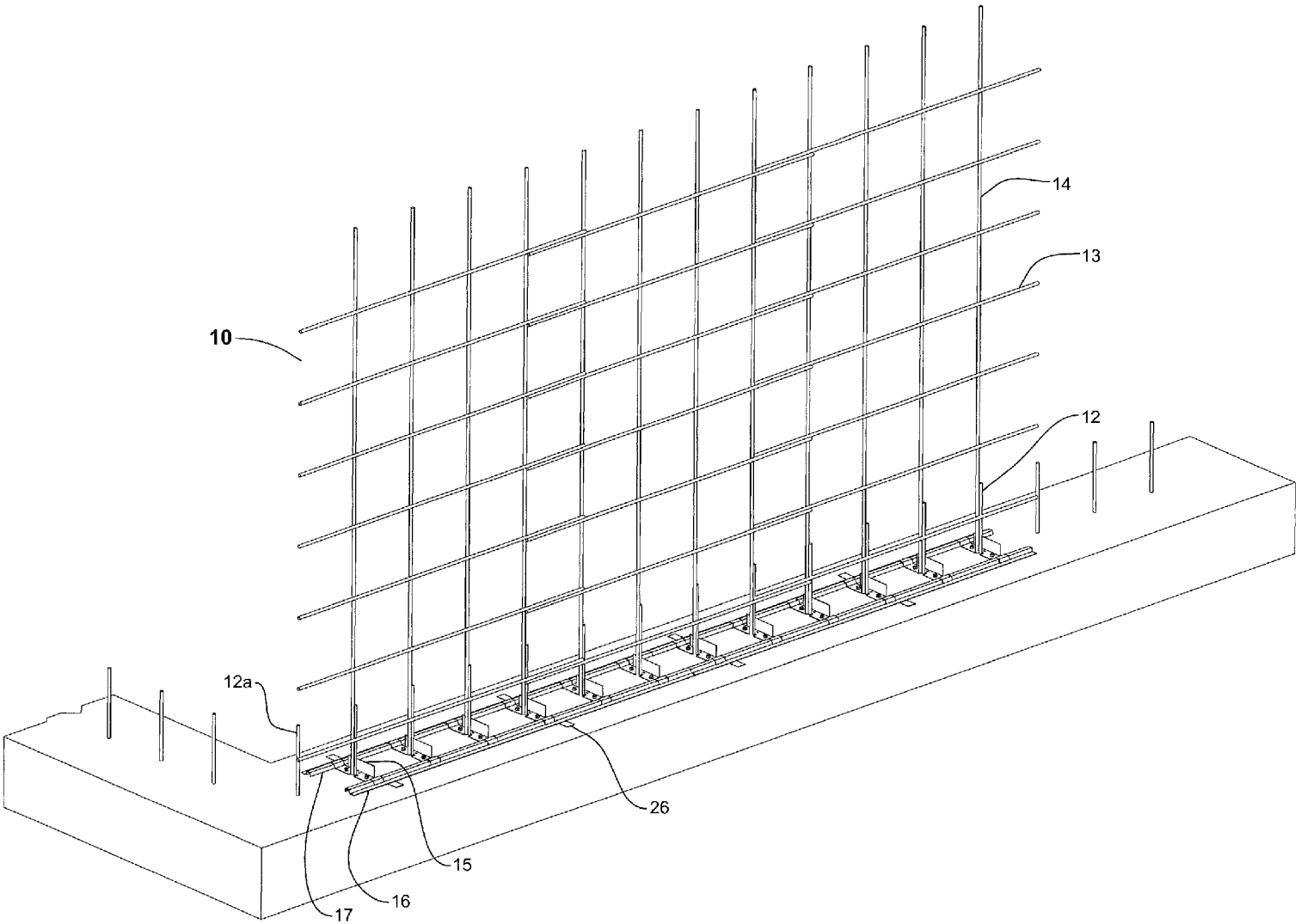
FIG. 2 is a partial perspective view of the grid assembly of FIG. 1 further employing a starter assembly for acting as a base for beginning the construction of a two-sided wall pursuant to the present method.
Figure 3:
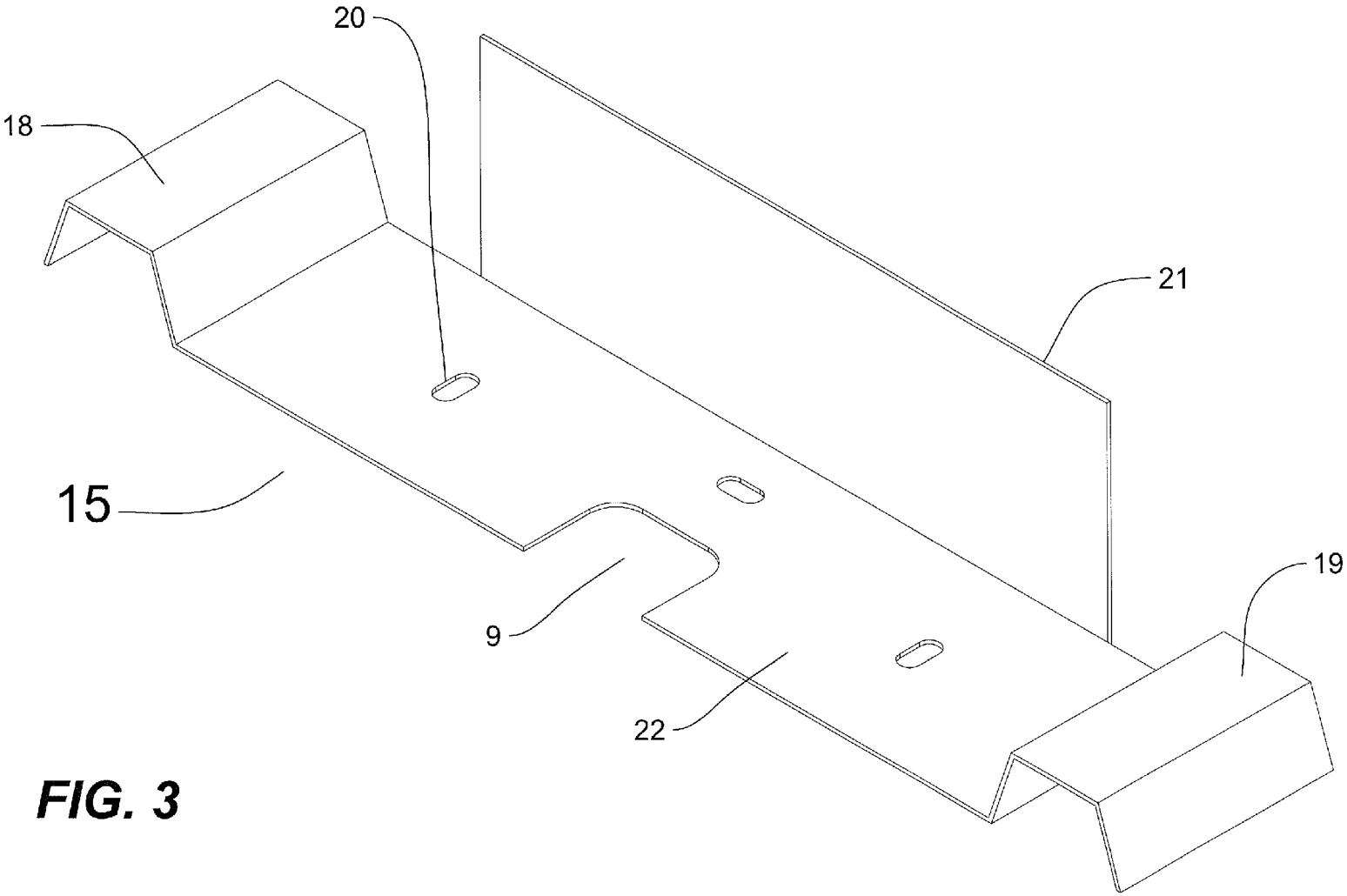
FIG. 3 is a perspective view of a starter bracket useful in the starter assembly of FIG. 2.
Figure 3A:
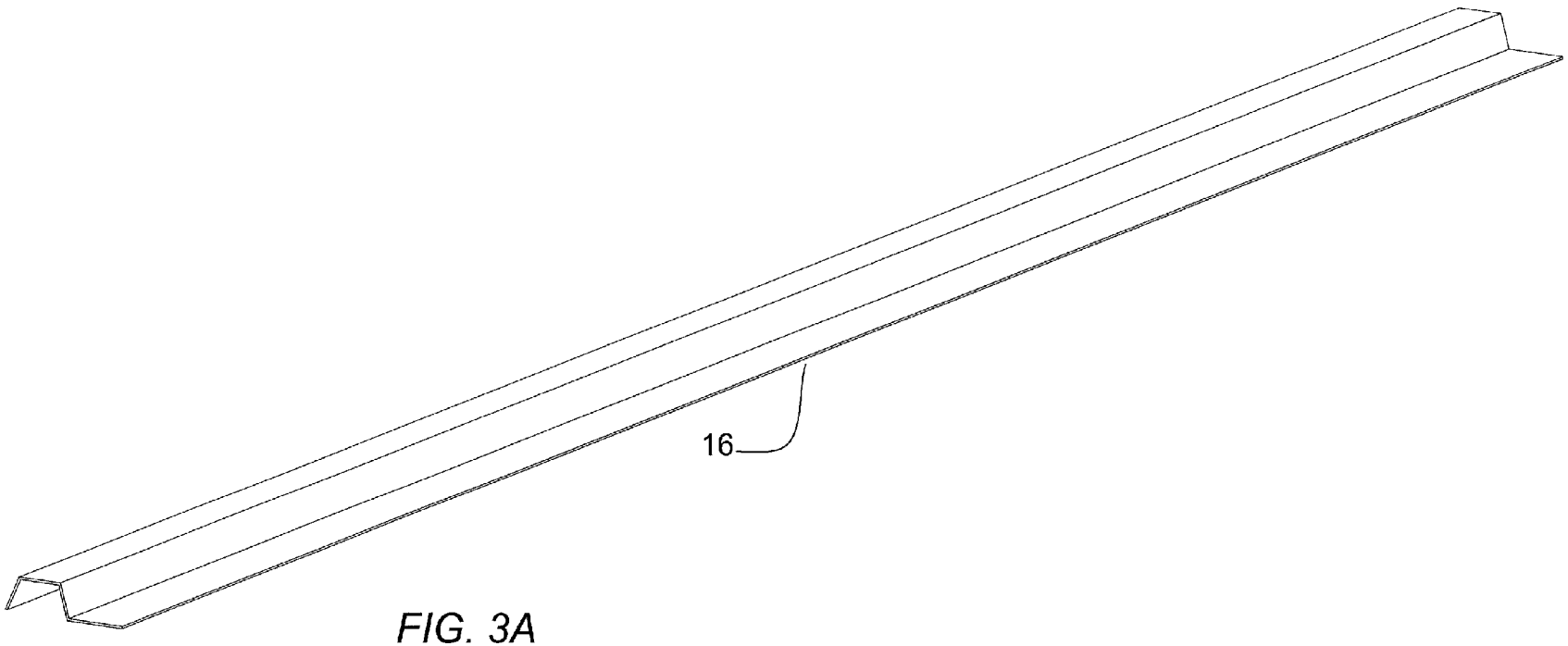
FIG. 3A is a perspective view of a starter alignment channel for use with the starter bracket of FIG. 3.

In order to facilitate the appropriate foundation footing for the to be constructed two-sided form wall, starter brackets FIG. 3 and starter alignment channels FIG. 3*a* are first applied to foundation footing 11 as illustrated in FIG. 2. In beginning the assembly method, first and second rows of alignment channels 16 and 17 of FIG. 2 are positioned on either side of reinforcing grid members 12 in parallel alignment therealong. Starter brackets 15, the details of which are depicted in FIG. 3, include medial span 22 between two terminal ends 18 and 19, each sized to capture an alignment channel. The starter brackets are also provided with penetrations 20 for receiving masonry fasteners and recess 9 to facilitate adjustable placement around vertically extending joined grid/reinforcement members 14/12. Vertically extending abutment plate 21 is optionally included to complete bracket 15 as shown.

Figure 4:
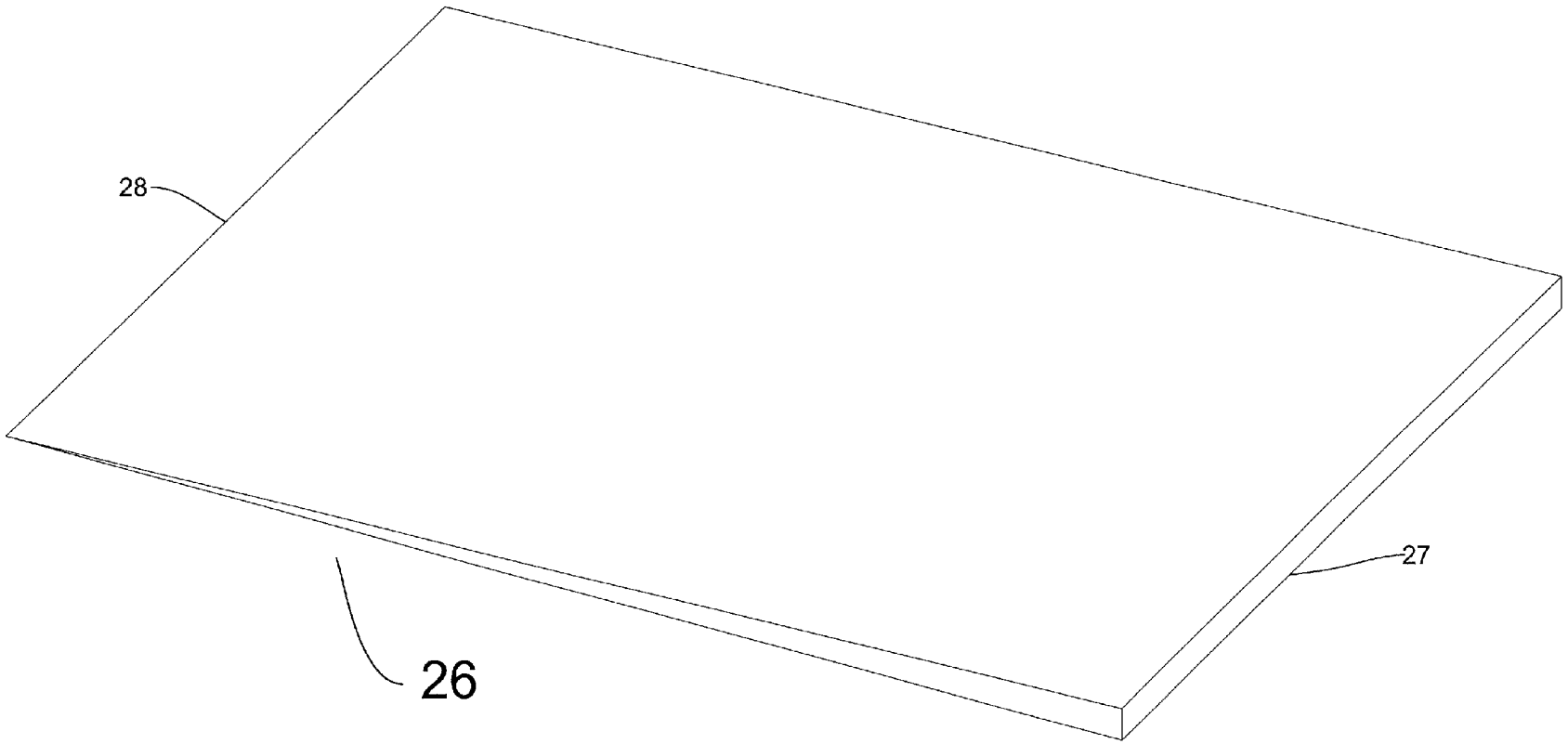
FIG. 4 is a perspective view of a shim used in the starter assembly of FIG. 2.

In assembly, alignment channels 16 and 17 are first applied to foundation footing 11 and thereupon, starter brackets 15 are passed through structural grid 10 enabling reinforcing members 12 and vertically extending grid members 14 to pass within recess 9 whereupon masonry fasteners can be applied. To the extent that accurate vertical and horizontal alignment between wall units is deemed necessary, shims 26 of FIG. 4 having a ramp surface such that shim 26 becomes thinner as one proceeds from end 27 to end 28 can be applied beneath one or both linear alignment channels 16 and 17 as shown in FIG. 2, as necessary to establish a level grade. A first course of planar wall units each having a bottom end consisting of a groove configuration can then be placed upon linear alignment channels 16 and 17 to begin the assembly method as more fully developed below.

Figure 5:
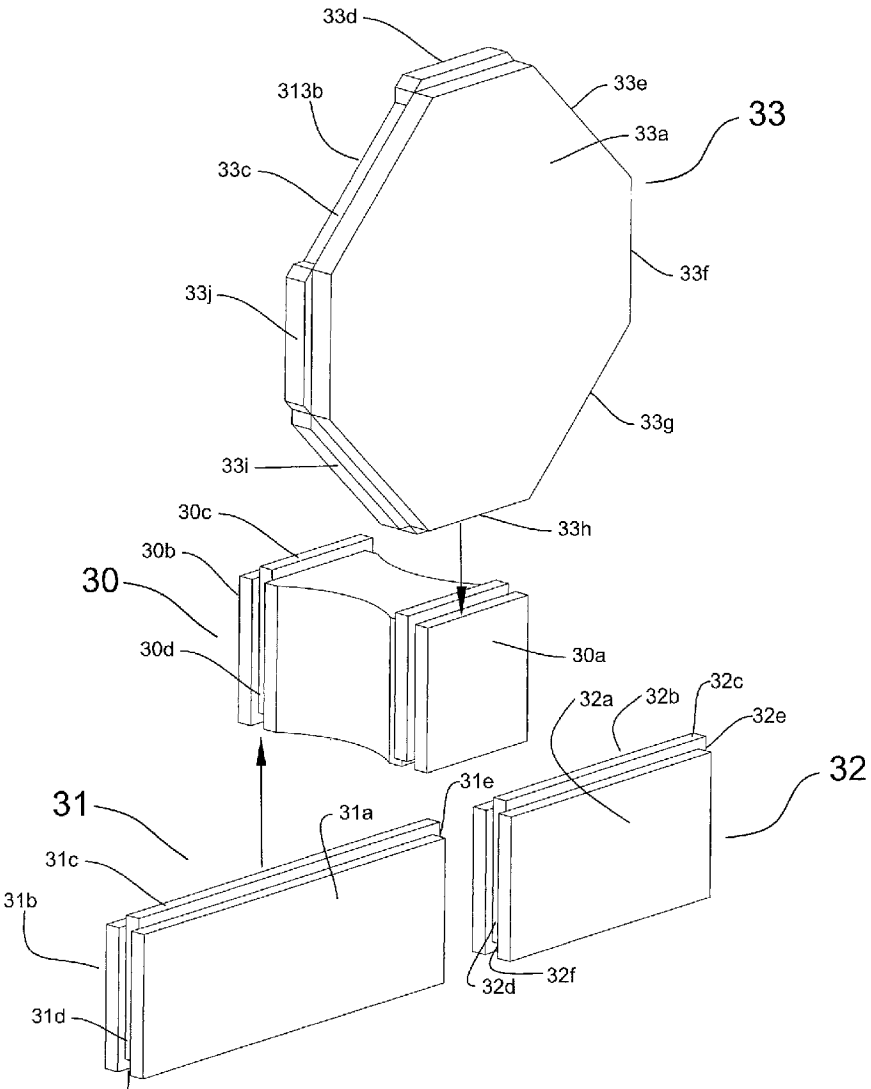
FIG. 5 are perspective views of multi-unit wall assembly components employed in a first embodiment of the present invention.
Figure 6:
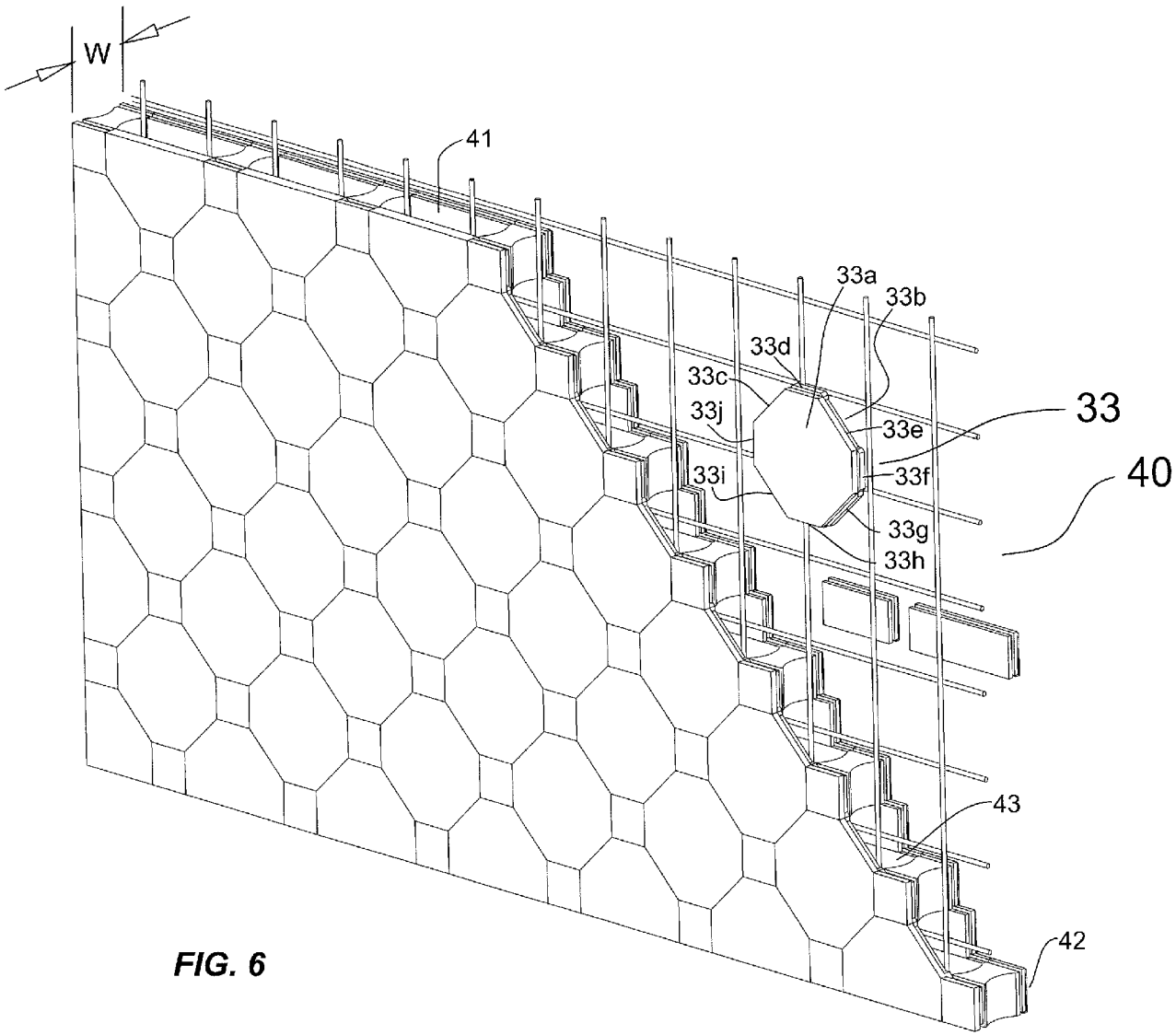
FIG. 6 is a perspective view of an embodiment of the present invention as a partially constructed two-sided wall illustrating an optional octagonal pattern as selected wall units.
Figure 7:
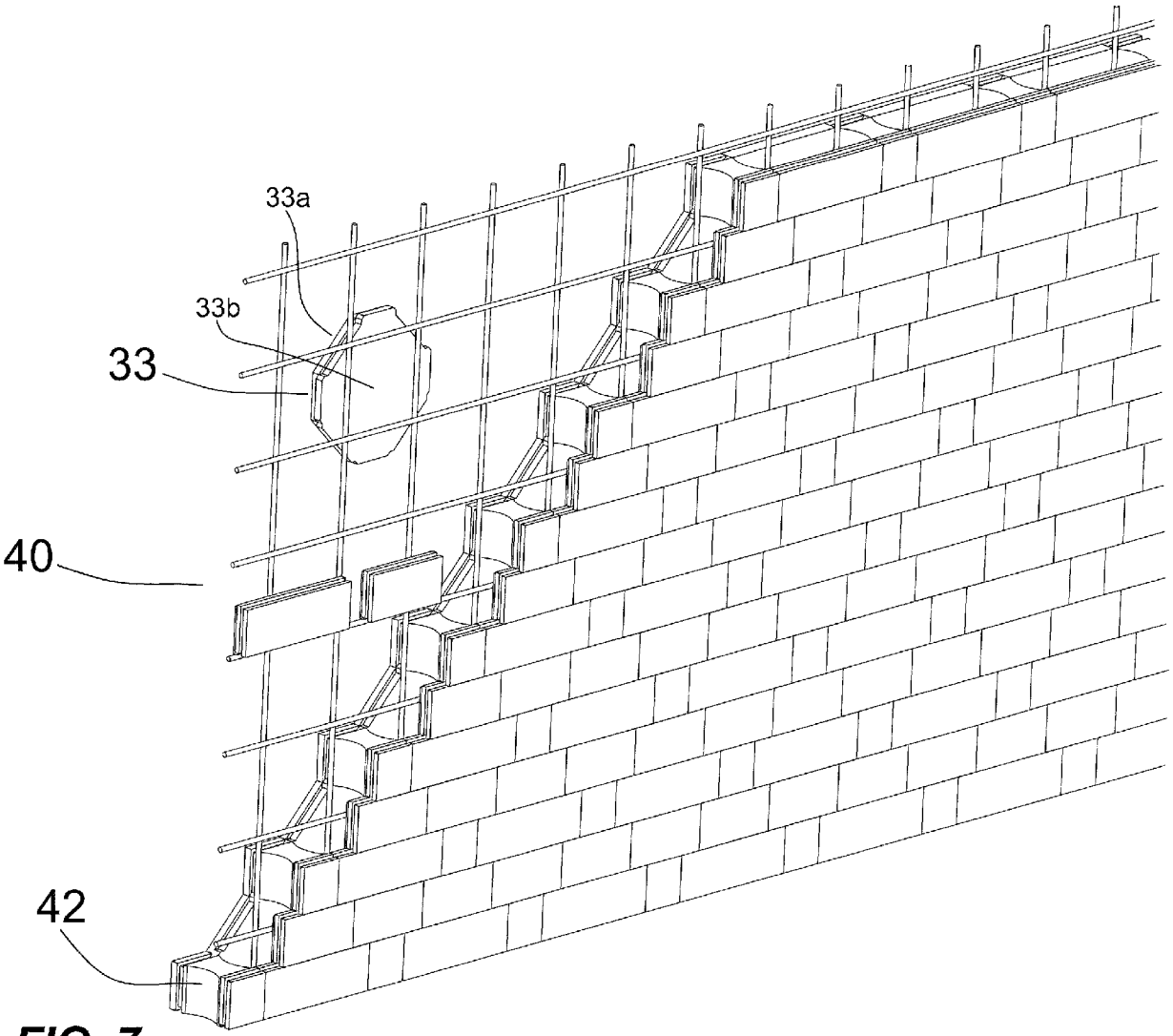
FIG. 7 is a perspective view of an embodiment of the partially constructed two-sided wall of FIG. 6 illustrating an opposing wall surface in comparison to that exposed in FIG. 6.

A first embodiment of the assembly method of the present invention is discussed in relation to FIGS. 5 through 7.

In turning to this first embodiment, the present method begins with structural grid 10 (FIG. 1) as the defining skeletal structure of wall 40 (FIG. 6). The method comprises providing a plurality of planar wall units 31, 32, 33, etc. and crossover connecting wall units 30. Each planar wall unit 31, 32 and 33 has substantially front and back faces 31*a*, 31*b*, 32*a*, 32*b*, 33*a*, 33*b*, respectively, the front faces being exposed as constituting exterior portions of wall 40, the back faces being directed to interior 41 of wall 40; wall 40 having a width "W" when erected. Planar wall units are provided with peripheral edges 31*c-f*, 32*c-f*, and 33*c-j*, the number determined by the geometric configuration of the wall units noting that rectangular wall units 31 and 32 have four peripheral edges while octagonal planar wall unit 33 has eight perimeter edges. Each perimeter edge is configured for mating with adjacent wall units and with terminal ends 30*a* and 30*b* of crossover connecting wall units 30.

In practicing the present method, crossover connecting wall units 30 pass through structural grid 10 between horizontally extending grid members 13 and vertically extending grid members 14 whereupon planar wall units are positioned on both sides of structural grid 10 to mate with crossover connecting wall units 30 at their perimeter edges. This process is repeated resulting in wall units being substantially self supporting across structural grid 10 to thereby complete first course 42 of two-sided form wall 40. In doing so, voids 43 are created for receiving structural or thermal insulating fill material between planar wall units to substantially fill the wall.

As noted, planar wall units and crossover connecting wall units comprise tongue and groove edges and rabbitted lap edges although square edges and other connecting interfaces can also be employed while remaining within the scope of the present invention. In comparing FIGS. 6 and 7 showing opposing exterior surfaces of wall 40, several characterizing features of this embodiment become readily apparent. As specifically noted in reference to FIG. 6, a first side of wall 40 depicts an exterior surface having octagonal planar wall units joined at their perimeters with complimentary edges of other octagonal planar wall units and the peripheral edges of terminal ends 30*a* of crossover connecting wall units 30. In reference to said first side of wall 40 of this preferred embodiment the perimeter edges of the octagonal planar units 33*c-j* and peripheral edges of the terminal end 30*a* of the crossover connecting unit 30 comprise a rabbitted lap interface On the opposing (FIG. 7) exterior surface of wall 40, rectangular planar wall units 32 abut and are mated to other rectangular planar wall units 31 and terminal ends 30*b* of crossover connecting wall units 30 wherein the perimeter edges 31*c-f* and 32*c-f* of said planar wall units and the peripheral egdes of the terminal end 30*b* of said crossover connecting unit comprise a tongue and groove interface. It should be appreciated that the peripheral edges on opposing terminal ends 30*a* and 30*b* of the crossover connecting unit 30 comprise different connecting interfaces allowing for different planar wall units and planar wall unit patterns on opposing sides of said two sides wall As such, at least some of the planar wall units on one side of two-sided wall 40 differ in shapes and sizes from at least some of the planar wall units on the opposite side of two-sided wall 40 wherein terminal ends 30*a* and 30*b* of crossover connecting wall units 30 are configured to mate with the perimeter edges of planar wall units on both sides of two-sided wall 40. This preferred embodiment allows for a two sided wall to be constructed from one side of the structural grid, wherein planar wall units 31 and 32 are sized to be passed through the structural grid to mate with a second terminal end 30*b* of the crossover connecting unit 30 on the opposite side of the wall from the worker/technician and the octagonal planar wall unit 33 is positioned to mate with a first terminal end 30*a* of the same crossover connecting unit 30 on the same side of the wall as the worker/technician, for the construction of decretive retaining walls where access to the wall is limited to one side of the grid.

Although one skilled in the art could readily appreciate various tongue, groove and rabbitted edges which could be joined to create the two sided wall of FIGS. 6 and 7, as an illustration, reference is made to FIG. 5 showing a typical example thereof. Specifically, crossover connecting wall unit 30 is provided with grooves 30*d* proximate face 30*b* and tongues 30*c* proximate face 30*b* although having grooves or tongues proximate both faces is also an embodiment useful in practicing the present invention. As is apparent from the figures, when crossover wall units are to be mated with rectangular wall units 31 and 32, or octagonal wall units 33, grooves 30*d* and tongues 30*c* are mated with, for example, the tongues on edges 31*c*, 31*e*, 32*c* and 32*e* of rectangular wall units 31 and 32 and rabbitted edges 33*c-j* of octagonal wall units 33 mate with the rabbitted edges of terminal end 30*a* of crossover connecting wall unit 30. As is apparent from the description made herein together with the drawings, the pattern of wall units can be the same or different on the opposing sides of the completed wall, the example shown in FIGS. 6 and 7 illustrating only rectangular wall units on one side and octagonal wall units on the opposite side, both displaying faces of crossover connecting wall units 30.

Figure 7A:
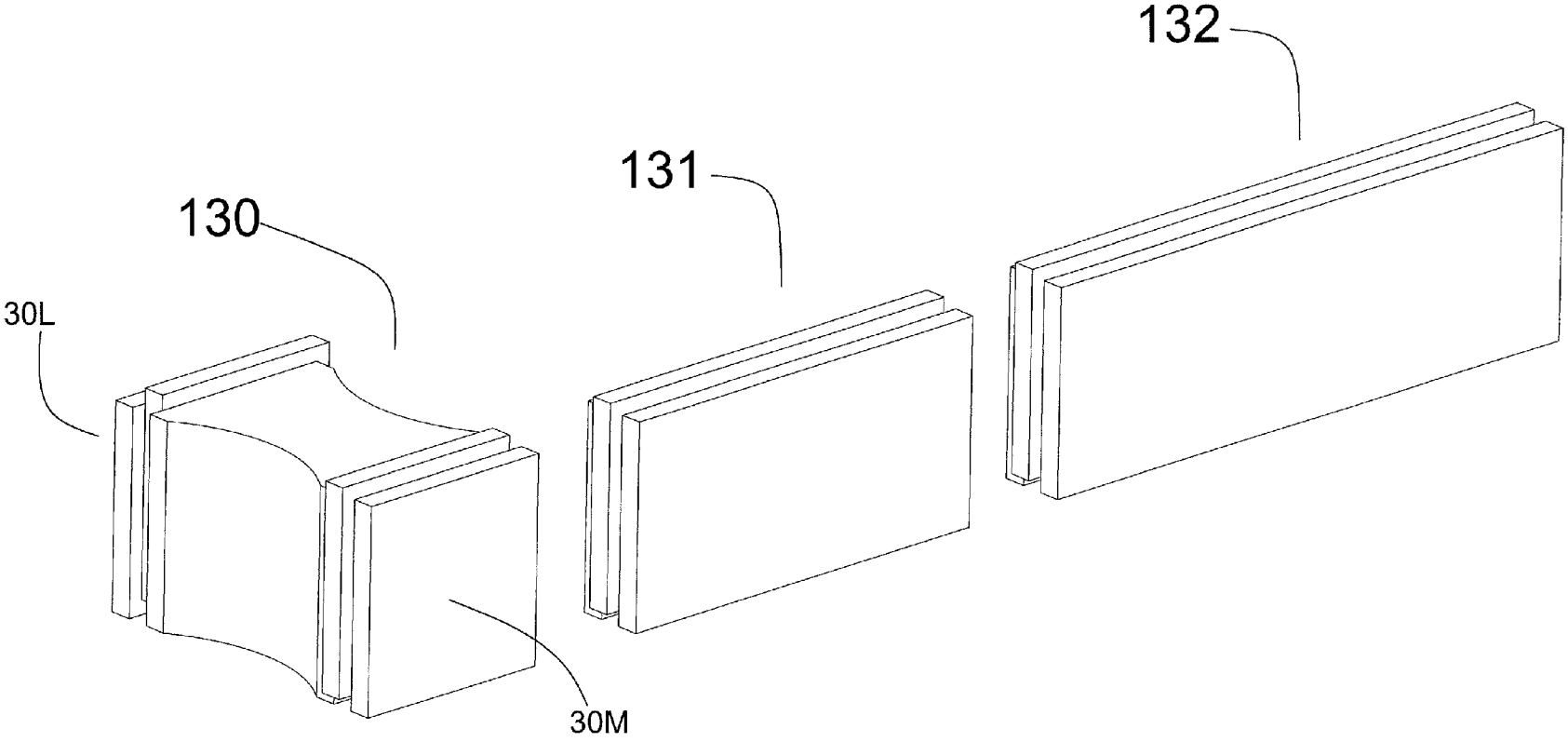
FIGS. 7A and 7B are perspective views of multi-wall assembly components and a partially constructed two-sided wall, respectively, employing said components as an alternative to that illustrated in FIGS. 5 and 7.
Figure 7B:
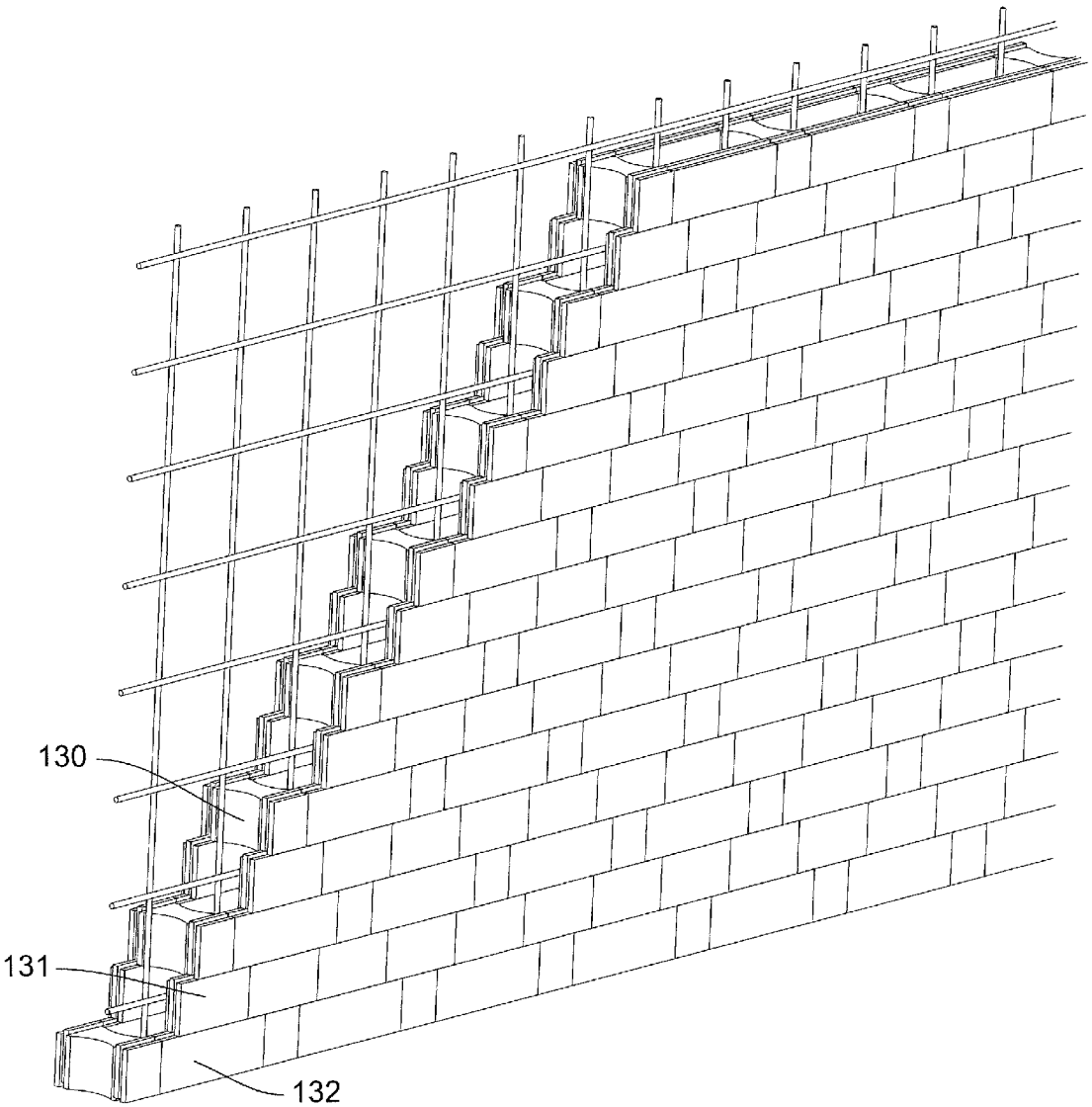

It should also be appreciated that crossover connecting wall units may comprise the same connecting interface on opposing terminal ends in order to mate with the same planar wall units on both sides of the two sided wall. As shown in FIGS. 7*a* and 7*b*. FIG. 7*a* showing the componants of the wall in FIG. 7*b*, wherein the crossover connecting wall unit 131 has the same connecting interface on opposing terminal ends 30*l* and 30*m* to mate with the same planar wall units 131 and 132 on both sides of the two sided wall.

As a next embodiment, reference is made to FIGS. 8 through 13.

Figure 11:
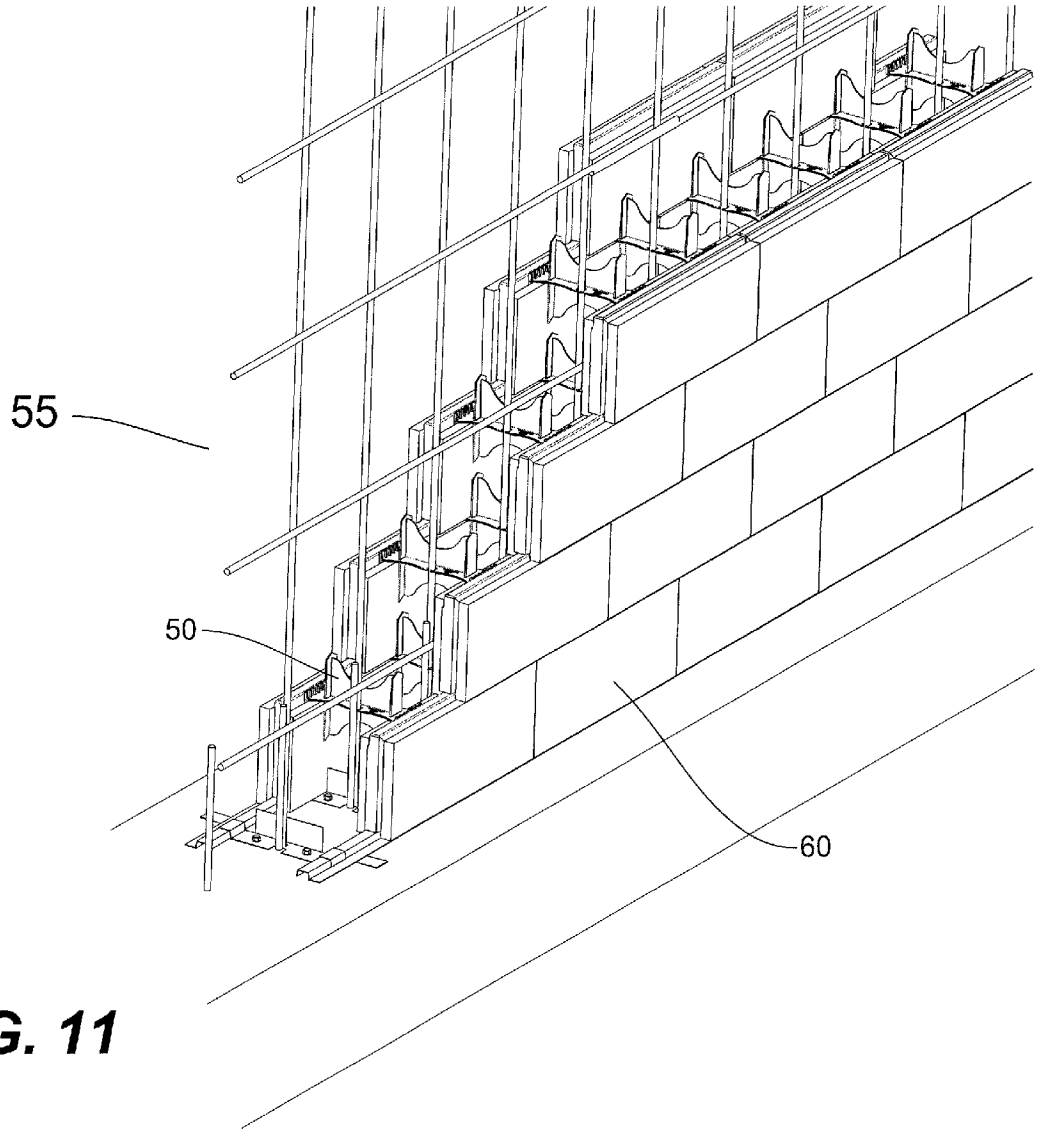
FIG. 11 is a perspective view of a partially constructed two-sided wall employing the inline wall unit of FIG. 10 as a partially constructed wall assembly.
Figure 12:
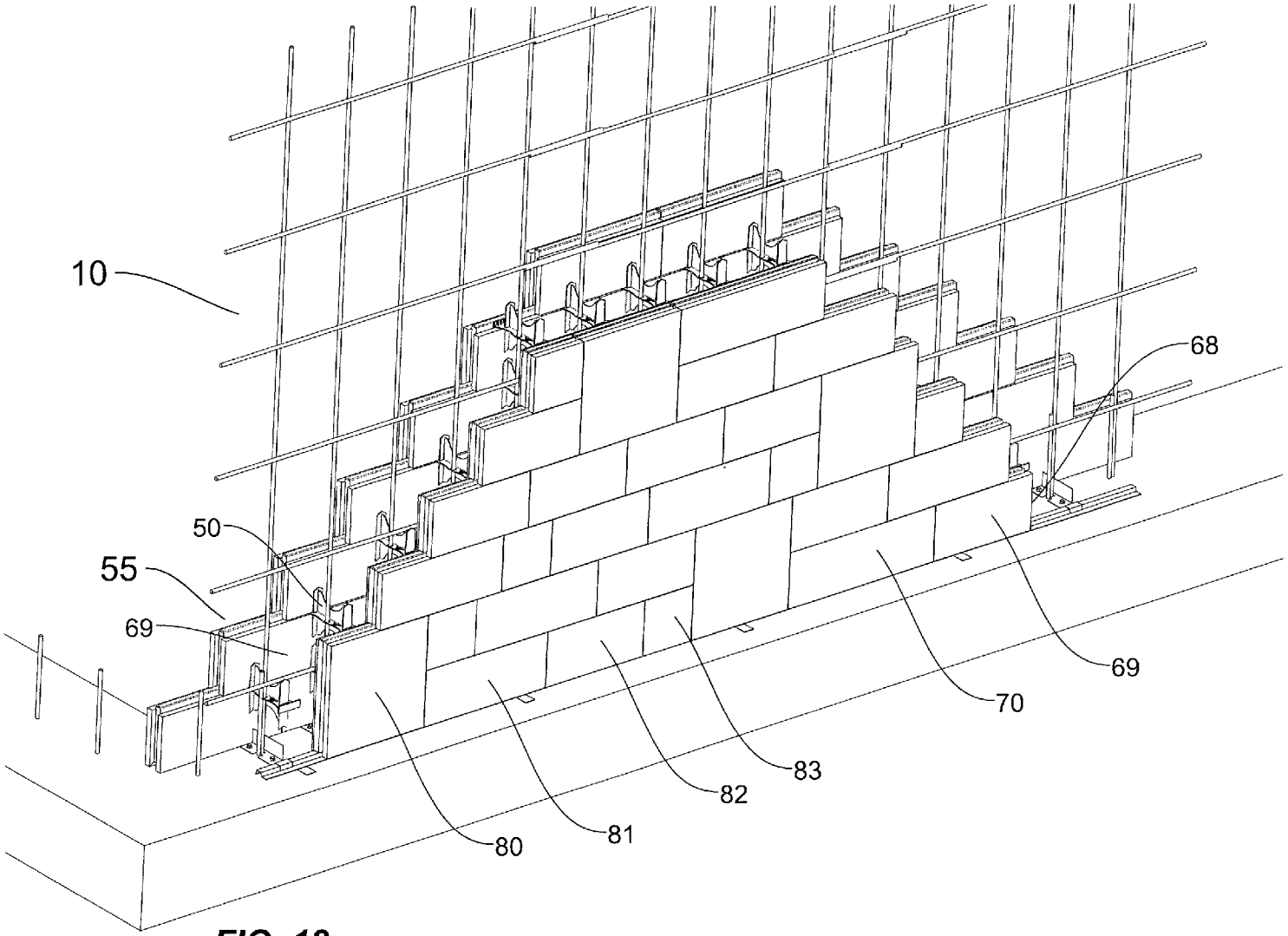
FIG. 12 is a perspective view of the partially constructed two-sided wall assembly of FIG. 11 illustrating its flexibility in enabling the construction of a wall having a diverse and varied planar wall unit pattern on one or both sides of a two sided wall.

Turning first to FIGS. 11 and 12, two-sided wall 55 is erected employing wall units 60 (FIG. 9) on either side of structural grid 10. Planar wall units 60 have generally planar front and back faces 60*a* and 60*b* with top, bottom and side edges 60*c* through 60*f*, these edges comprise tongues 63 and 64 and grooves 65 and 66, respectively, to facilitate wall unit to wall unit joining on both sides of two-sided wall 55. It is further noted that top edge 60*c* of planar wall unit 60 further comprises a combination of both tongue 63 and groove 62 running side by side for the entire length of the top edge.

In practicing the present invention, first row or course 68 of wall units 69, 70, etc. are positioned atop starter brackets and alignment channels noting that groove 66 receives an alignment channel as discussed. Connecting brackets 50 (FIG. 8) are provided having medial span 51 of approximately the width between opposing planar wall units, medial span 51 having recess 52 for selectively receiving and retaining a member of structural grid 10. Terminal ends of connecting bracket 50 comprise double tongue 53, with portions 54 and 56 extending above and below medial span 51 respectively. Bottom portion 56 of double tongue 53 is sized to capture the top edges 60*c* of opposing planar wall units 60 within the groove 62 of their tongue and groove combination whereupon top portion 54 of double tongue 53 is intended to be captured by bottom groove 66 of edge 60*f* of a subsequent course as one constructs double sided wall 55.

Figure 10:
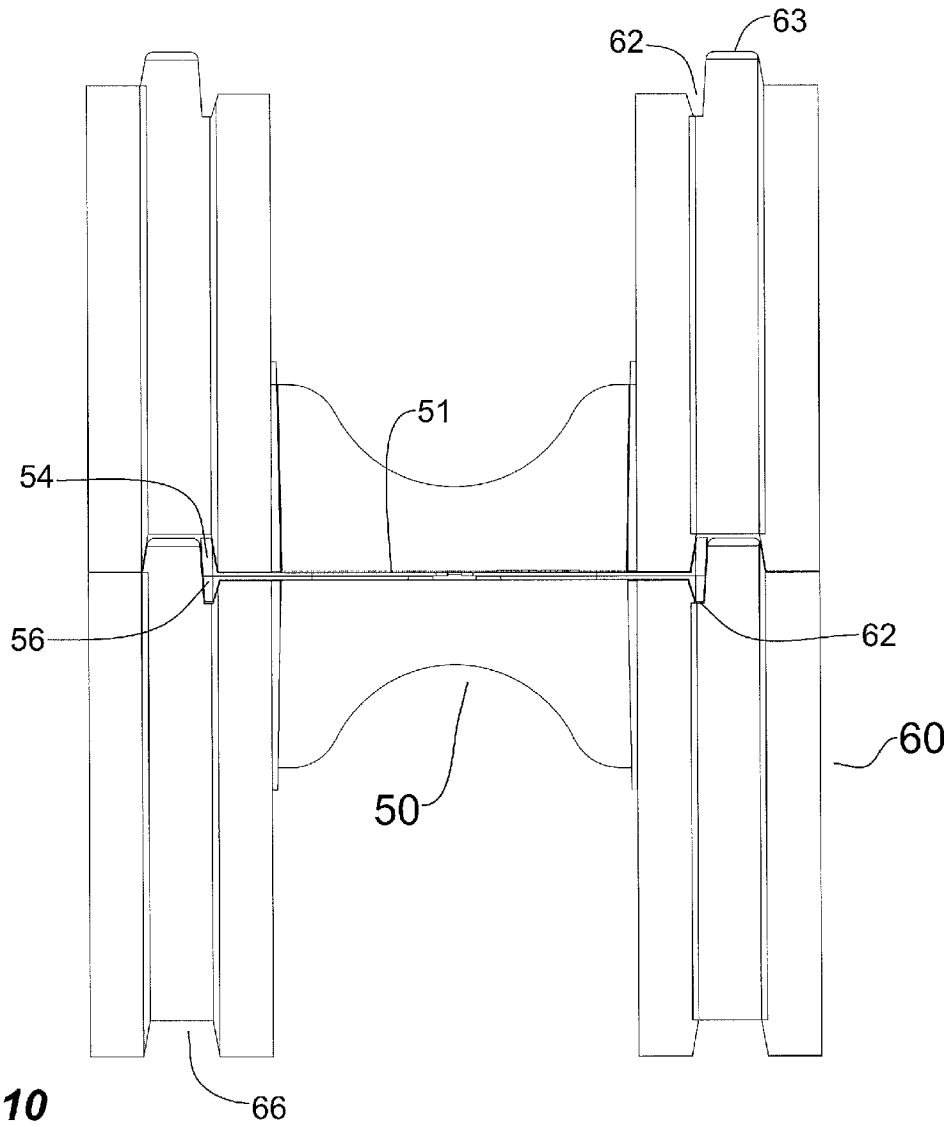
FIG. 10 is a side plan view of an inline wall unit illustrating the joiner of the inline connecting bracket of FIG. 8 with the wall units of FIG. 9.

The combination of connecting bracket 50 with planar wall units 60 built one over the other to create courses can best be visualized in reference to FIG. 10. In practice, a plurality of connecting brackets 50 are placed through structural grid 10 and are connected to members of the structural grid within said recess 52 of medial span 51. Subsequently, bottom portion 56 of double tongue 53 are placed within grooves running the length of the tongue and groove combination on top edges 60*c* of opposing planar wall units 60 of first row 68 of two-sided wall 55, the planar wall units being gauged from and supported by structural grid 10 during planar wall unit assembly thereby completing first row or course 68 of planar wall units 60. Subsequent courses of planar wall units are built upon lower courses as suggested by FIGS. 11 and 12 by seating groove 66 of bottom edge 60*f* of subsequent planar wall units upon tongues 63 of top edges 60*c* together with the top portion 54 of the double tongues 53 of connecting brackets 50 until courses are substantially of predetermined length and height whereby engagement of connecting brackets 50 to structural grid members 14 and subsequently to opposing planar wall unit 60 creates continuous void 69 (FIG. 12) between planar wall units 60 through which structural grid 10 extends thus enabling the placement and containment of structural or thermal insulating fill therein.

It is noted that planar wall units 60 are configured such that their tongue and groove combinations are sized for capturing double tongue sections 53 of connecting brackets 50 between adjacent planar wall units noting further that groove 66 on bottom edge 60*f* of planar wall units 60 is sized to receive both the tongue 63 and the top portion 54 of the double tongue 53 of connecting bracket 50 while the groove 65 of planar wall units 60 is sized to receive tongue 64 of an adjacent planar wall units facilitating the building of courses vertically and horizontally until double sided wall 55 is fully constructed.

As a preferred embodiment, it is intended that groove 62 run the entire length of top edge 60*c* of adjacent planar wall units configured to capture bottom tongue 56 of the connecting brackets double tongue as best seen in reference to FIG. 10 enabling positioning of bracket 50 within groove 62 so as to capture members of structural grid 10 and opposing planar wall units 60 at any location along their top edges. As a further improvement embodiment, malleable tab 71 is located in medial span 51 to define recess 52. Malleable tabs 71 frictionally retain the appropriate structural grid members within recess 52.

As with all the embodiments disclosed herein, both sides of the form wall 55 can be erected from a single side of structural grid 10 which is considered a significant improvement in comparing the present method with construction methods of the prior art.

It should also be understood that the two sided form wall in all the embodiments of the present invention can be erected after the unimpeded installation of utility lines attached directly to the structural grid which is also considered a significant improvement in comparing the present method with construction methods of the prior art.

In comparing the two sides of wall 55 illustrated in FIGS. 11 and 12, it is noted that planar wall units 60 can be configured on one side of wall 55 (FIG. 11) while contrasting planar wall units of multiple shapes 80, 81, 82 and 83 can be configured on the opposite side of wall 55 to create contrasting patterns on both sides of two-sided wall 55. As in this illustration, a variable pattern of planar wall units (FIG. 12) of multiple shapes and sizes can characterize one side of wall 55 while on the opposite side of wall 55 (FIG. 11) planar wall units are a uniform shape and size creating a repetitive and consistent pattern thereupon. It should also be appreciated that the two sided form wall of the present invention can have the same variable or uniform pattern on both sides of the two sided wall and wall units can be provided with a completed finish wherein the erected wall needs no subsequent finish applied.

Figure 8:
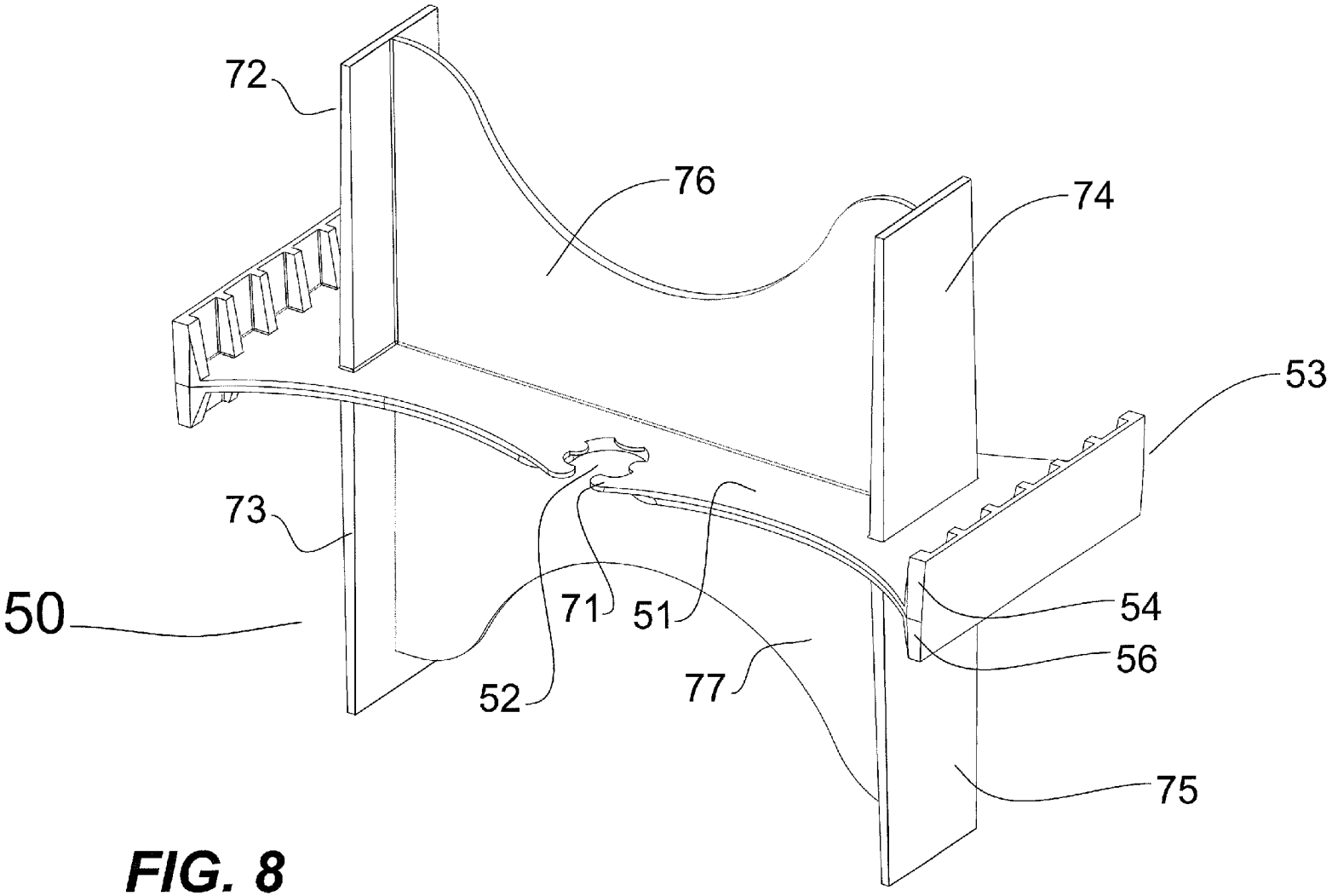
FIG. 8 is a perspective view of an inline connecting bracket used in one of the embodiments of the present invention.
Figure 9:
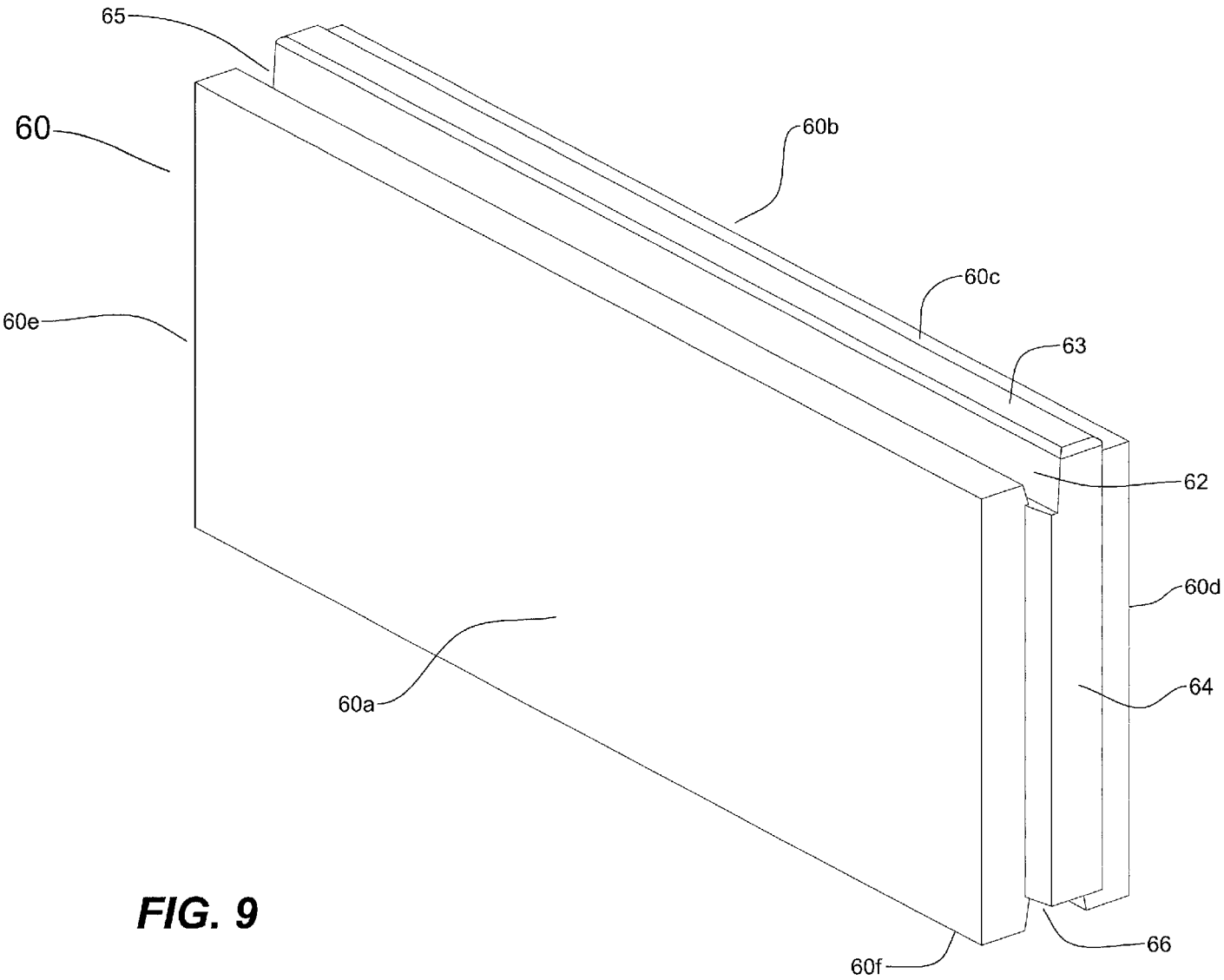
FIG. 9 is a perspective view of a planar wall unit used with the inline connecting bracket of FIG. 8 to complete one of the embodiments of the present invention.

It is further noted that, as a preferred embodiment, alignment plates 72, 73, 74 and 75 of FIG. 8 are configured to extend above and below medial span 51 of connecting brackets 50 which are secured by bridge plates 76 and 77. Alignment plates 72 through 75 are intended to abut the interior surfaces of planar wall units and assist in securing their proper registry until appropriate fill material has been introduced to voids 69 as previously discussed.

Figure 13:
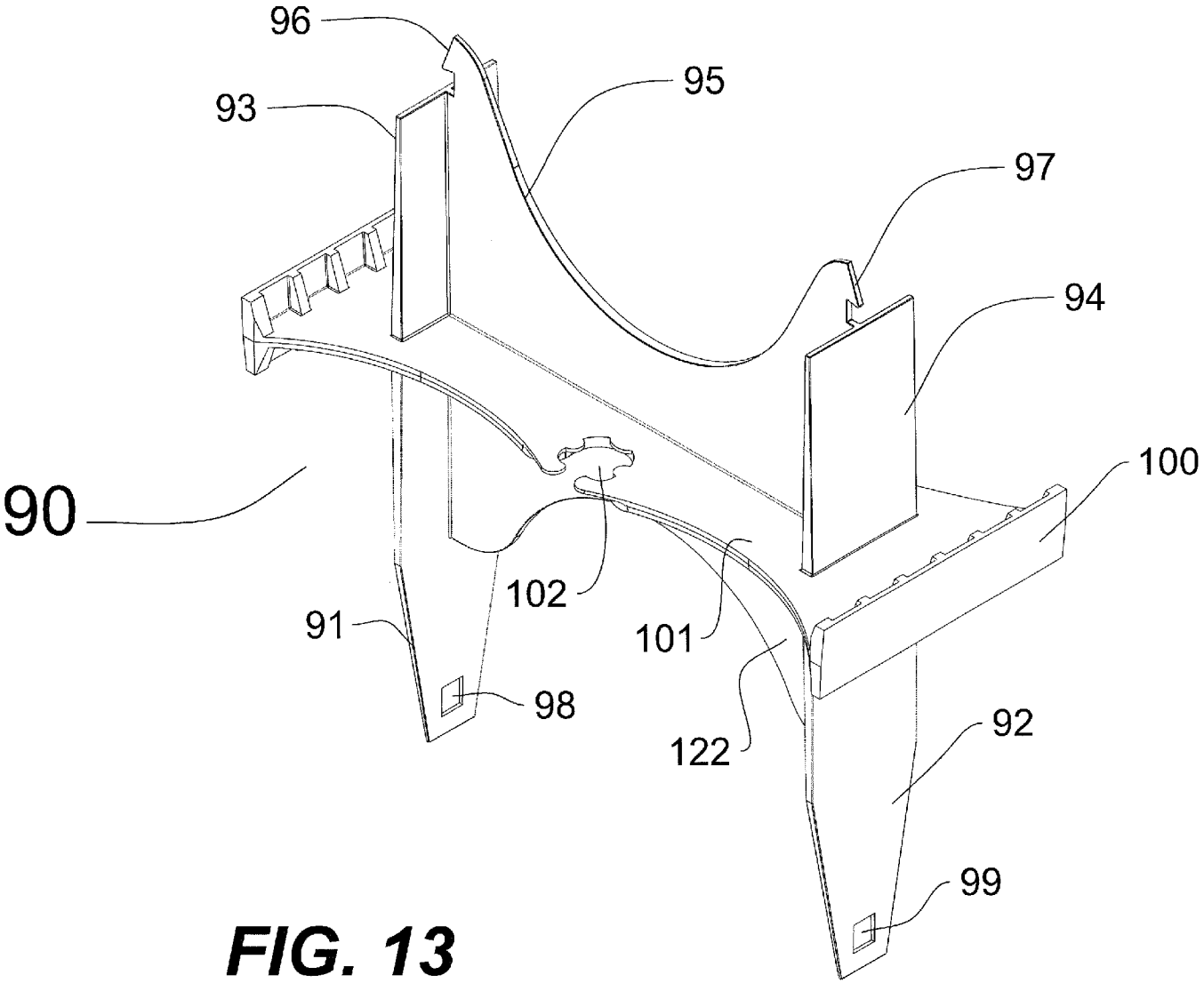
FIG. 13 is a perspective view of yet another embodiment of an inline bracket used in the present method of assembling a two-sided wall.
Figure 14:
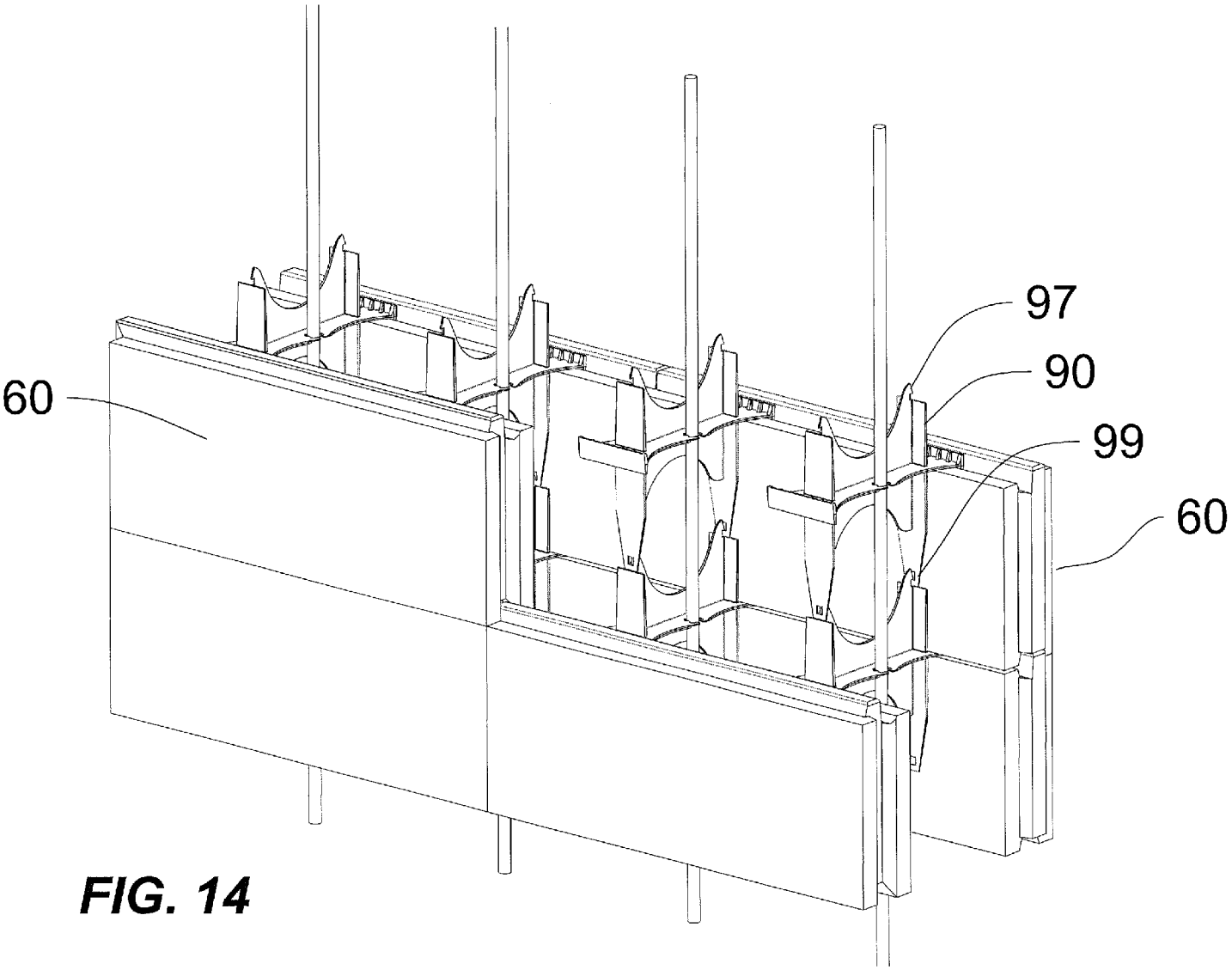
FIG. 14 is a partial perspective view of a portion of a two-sided wall assembled employing the bracket of FIG. 13.

As yet a further embodiment of the present invention reference is made to FIGS. 13 and 14. In this instance, connecting brackets 90 being closely related to connecting bracket 50 of FIG. 8 have double tongue 100, medial span 101, recess 102 for receiving sections of rebar of the structural grid, alignment plates 91, 92, 93 and 94 below and above medial span 101 and bridge plates 95 and 122 above and below medial span 101, respectively. In this embodiment, bridge plate 95 comprises hooks 96 and 97 and alignment plates 91 and 92 comprise openings 98 and 99 sized to receive hooks 96 and 97 of the connecting brackets 90 of the course below such that upon placement of connecting brackets between planar wall units, the connecting brackets lock to one another so as to provide a course to course interlock in the two-sided wall assembly. This is depicted in FIG. 14 noting the placement of crossover connecting brackets 90 between planar wall units 60 with hooks 97 received by openings 99.

Figure 15:
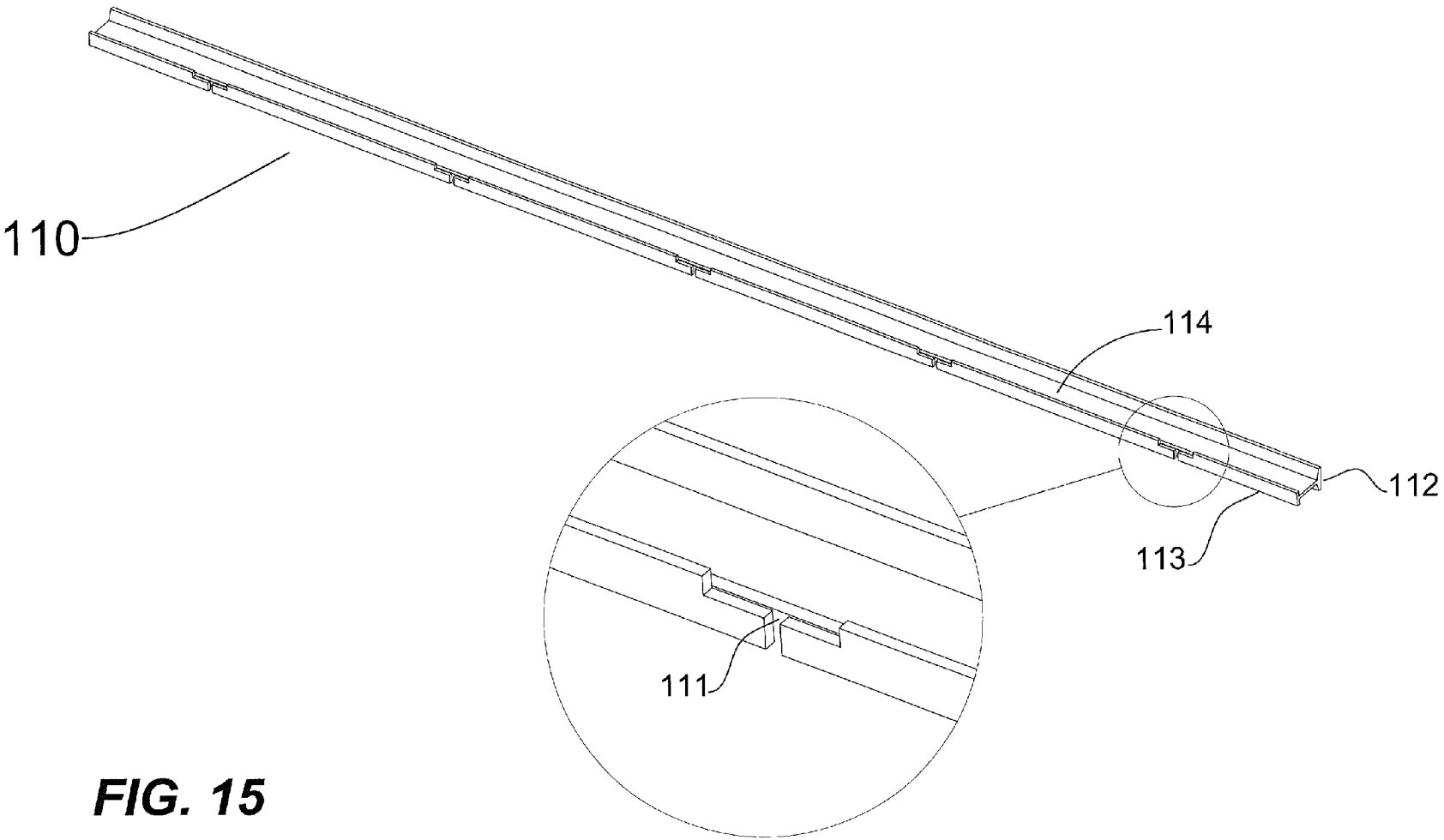
FIG. 15 is a perspective view with partial enlargement of an inline wall alignment channel bracket used in yet another embodiment in practicing the present assembly method of a two-sided wall.
Figure 16:
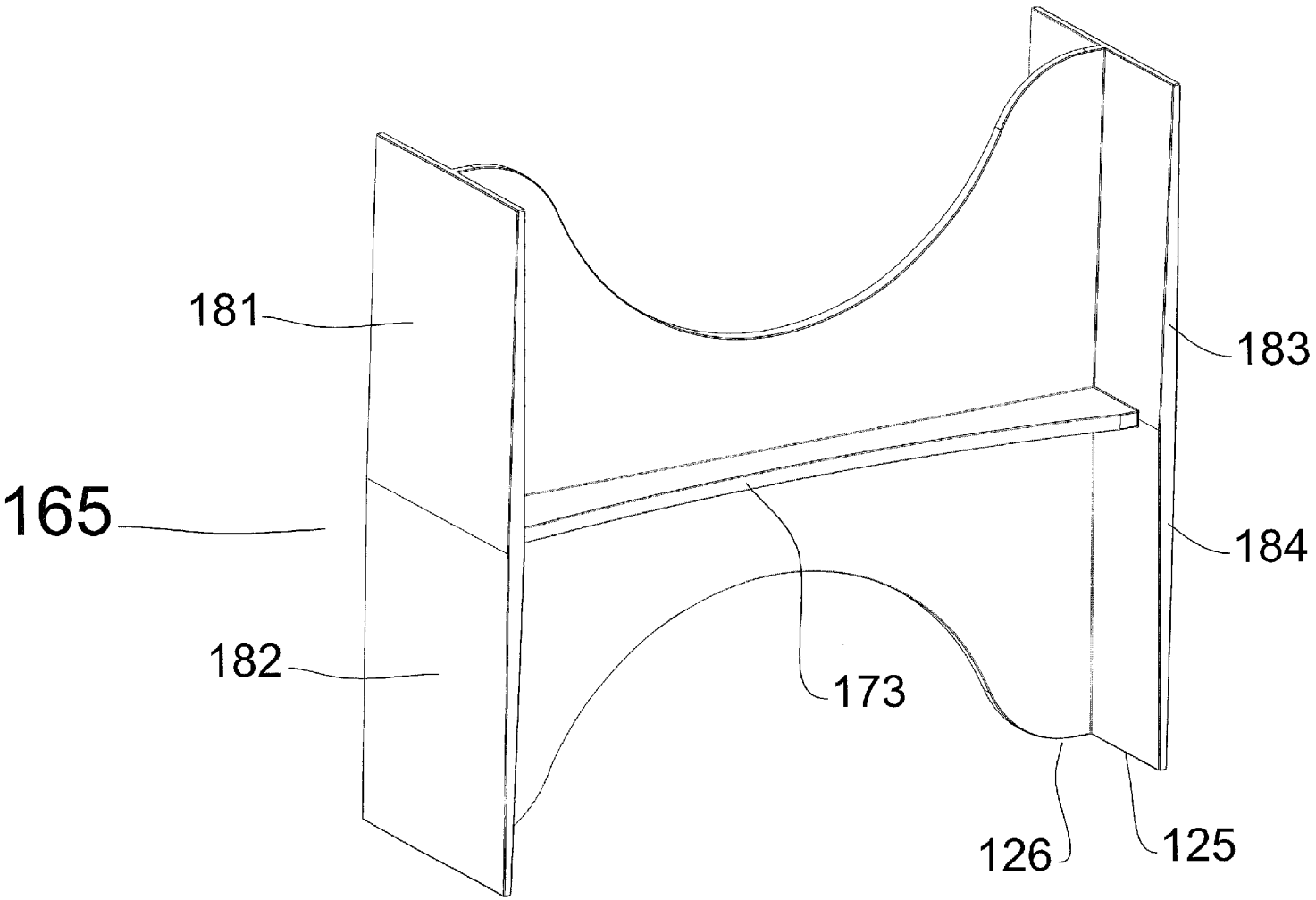
FIG. 16 is a perspective view of a medial interlocking bracket for use with the inline wall alignment channel bracket of FIG. 15.
Figure 17:
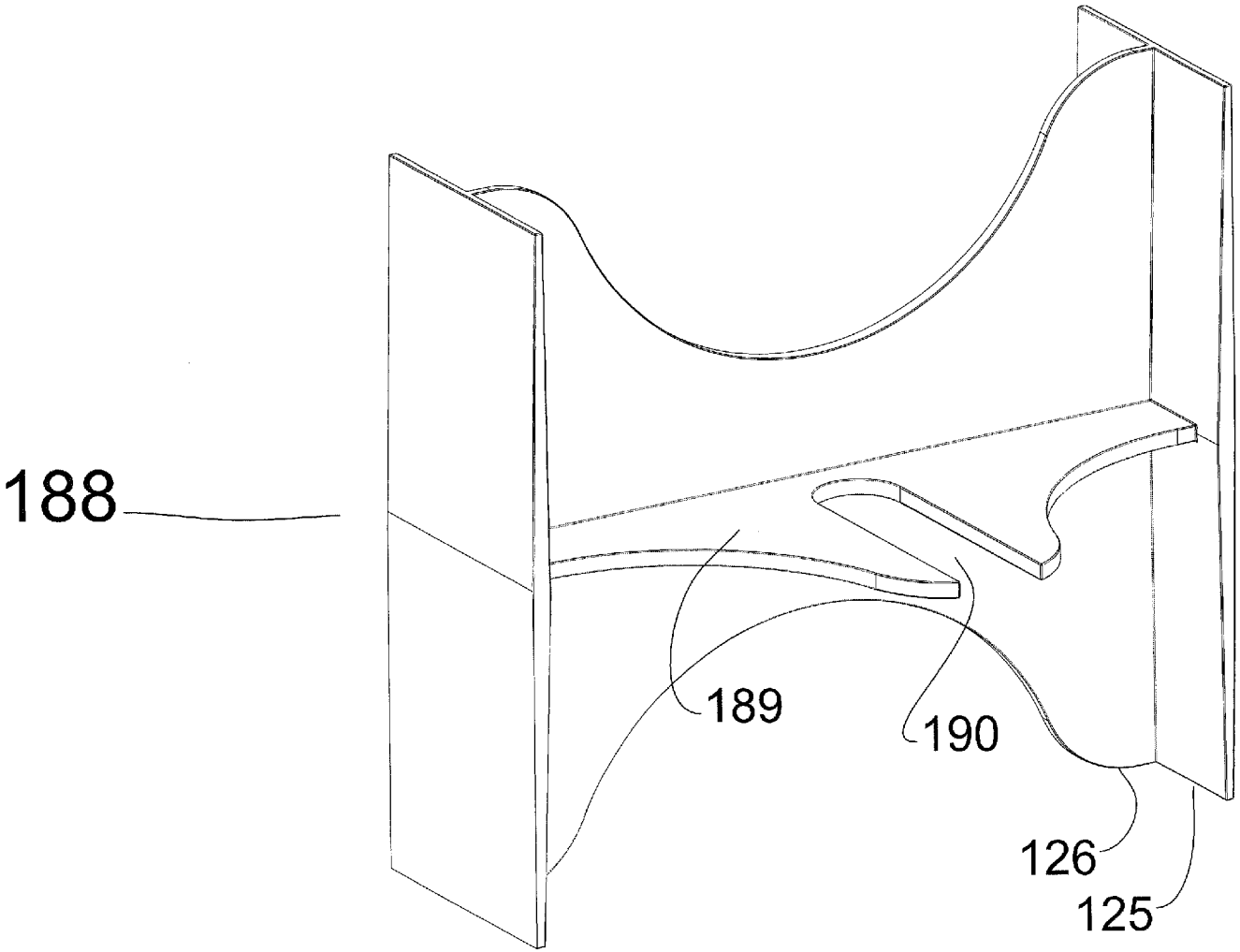
FIG. 17 is a perspective view of a medial interlocking bracket for use with the inline wall alignment channel of FIG. 15 with rebar recess for receiving vertically extending grid member.
Figure 18:
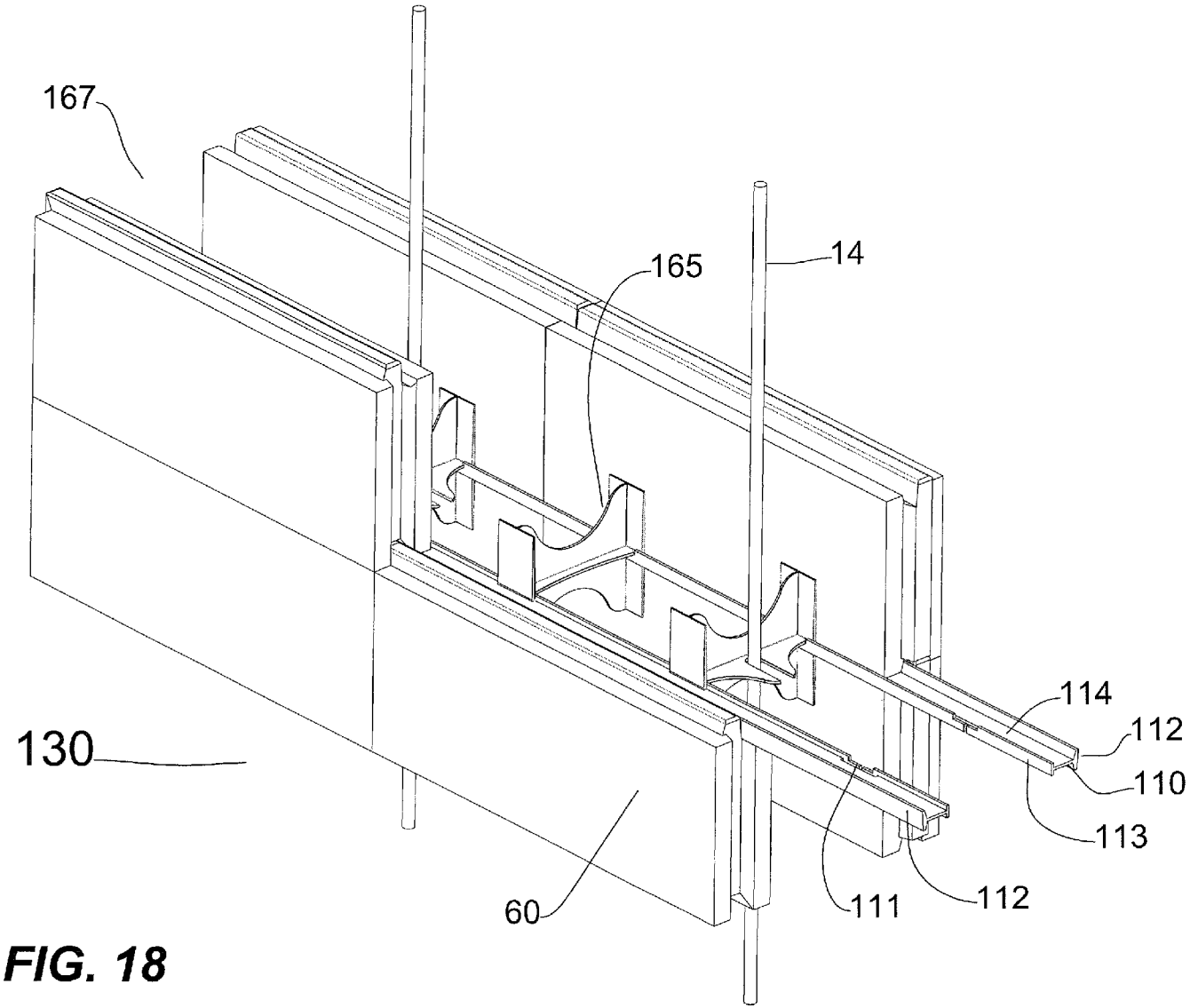
FIG. 18 is a perspective view of a segment of a wall assembly employing the alignment channel bracket of FIG. 15 and the medial interlocking brackets of FIGS. 16 and 17.

Reference is next made to FIGS. 15 though 18 disclosing yet another embodiment of the present invention. As in the previously discussed embodiments, two-sided wall 130 (FIG. 18) is erected about a structural grid 10, vertically extending grid members 14 included for illustrative purposes. A first row of planar wall units 60 (FIG. 9) are positioned on one side of structural grid 10 and a second row of planar wall units 60 are positioned on an opposite side of structural grid 10 opposing the first row. A plurality of linear wall channel brackets 110 are shaped as I-beams comprising a first rail 112, medial span 114 and a second rail 113 running parallel to first rail 112 for the length of the substantially linear wall channel bracket 110. First rail 112 is characterized as being in the form of a double tongue much like double tongue 53 of bracket 50, the double tongue extending above and below medial span 114 and running the substantial length of linear wall channel bracket 110. The bottom portion of double tongue of the first rail 112 is sized to capture and fit within the top edges of opposing planar wall units 60 by fitting within the groove portions of their tongue and groove combinations. The top portion of double tongue 112 is captured by the bottom edge groove of planar wall units of a subsequent course, the second rail 113 being discontinuous having evenly spaced recesses 111 configured substantially along its length sized to selectively receive and retain end shoulders 125 and 126 (FIGS. 16 & 17) of interlocking medial brackets 165 & 188, interlocking medial brackets 165 & 188 sized to span interior 167 of two-sided wall 130 to establish the width of said wall.

In use, a first wall channel bracket 110 is placed atop a first row of planar wall units 60 on a first side of structural grid 10 by seating the lower portion of double tongue 112 in the groove portion of the tongue and groove combination atop wall units 60 noting that by doing so, second rail 113 overhangs the first row of planar wall units on their interior sides. Subsequently, a second linear wall channel bracket 110 is placed on a second row of planar wall units 60 located on the opposite side of structural grid 10 opposing the previously installed linear wall channel bracket 110 by seating the lower portion of the double tongue 112 of the second wall channel bracket in a groove portion of the tongue and groove combination of the top edge of the second row of planar wall units 60 noting that by doing so, second rail 113 of second linear wall channel bracket 110 overhangs the second row of planar wall units 60 on their interior sides in an opposing orientation to the first wall channel bracket 110. A plurality of interlocking medial brackets 165 each comprising a horizontally disposed medial span 173 and opposing vertically disposed end shoulders 181, 182, 183 and 184 are installed, the end shoulders being configured to fit and interlock within said evenly spaced recesses 111 of second rails 113 of opposing linear wall channel brackets 110. When employing interlocking medial bracket 188 (FIG. 17) medial span 189 is provided with an elongated recess 190 such that when interlocking medial brackets 188 are passed through the structural grid above opposing wall channel brackets, vertically extending grid member 14 will seat at variable depths within the elongated recess 190 while end shoulders 125 and 126 are seated within opposing linear wall channel brackets 110 in evenly spaced recesses 111 to connect opposing linear wall channel brackets 110 across the structural grid while securing and aligning opposite rows of planar wall units 60 on both sides of the two sided wall. Subsequent courses of planar wall units are applied upon lower courses of planar wall units by seating the bottom edge groove of subsequent planar wall units atop the collective tongue profile of previously applied wall channel brackets and the tongue and groove edges atop previously applied planar wall units to erect a wall of a predetermined length and height. Engagement of interlocking brackets 165 or 188 to opposing linear wall channel brackets 110 creates a continuous self supporting two-sided wall having an internal void within space 167 through which structural grid 110 extends thus enabling placement and containment of structural or thermal insulating fill therein.

When interlocking medial brackets 188 are employed, a plurality of such interlocking brackets are passed through structural grid 10 and are attached to reinforcing members of the structural grid at said elongated recess 190 in medial span 189 thereupon terminal end shoulders 125 and 126 of the interlocking medial brackets fit snugly within spaced recesses 111 of opposing linear wall channel brackets 110 to thus secure and align opposing rows of planar wall units 60 on both sides of the two-sided wall whereby the opposing rows of wall units are gauged from and are supported by structural grid 10 during assembly. It should also be appreciated that interlocking medial bracket 188 can be rotated about its vertical axis in order to receive grid members from either side for added alignment potential with the evenly space recesses of the wall channel brackets Subsequent courses of planar wall units 60 are built upon lower courses of planar wall units 60 by seating the bottom edge groove of planar wall units about the collective tongue profile of the top portion of wall channel brackets and of planar wall unit tongue and groove combinations.

By practicing the present invention, one can erect a two-sided wall with an ease of construction unmatched by prior designs. Planar wall units can be gauged from a pre-erected structural grid such that their placement and alignment is securely established being gauged from the structural grid members during assembly. Various interconnecting medial brackets are designed to securely retain opposing planar wall units such that during assembly, no external vertical bracing is necessary throughout wall construction. By contrast the prior designs teach the use of vertical bracing at least or until cementitious fill material is applied to ensure that the wall remains plumb and without bulges or indents. Construction of two-sided walls pursuant to the present invention enable one to create a finished external surface with no post erection glazing or surface treating enabling a user to vary the patterns between opposing external wall surfaces, again, without the need for any surface treatment.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A method of assembling a two-sided wall having a predetermined length, width and height, comprising the steps of:

a. completely erecting a structural grid comprising a plurality of vertically extending reinforcing members and horizontally extending reinforcing members substantially of the predetermined length and height to provide an internal, skeletal structure of the two-sided wall wherein said structural grid is attached to a plurality of reinforcing members extending vertically from a structural concrete foundation footing;

b. providing a plurality of planar wall units having a planar front and back faces with top, bottom and side tongue and groove edges to facilitate planar wall unit to planar wall unit joining on both sides of the two-sided wall wherein said top edge of each planar wall unit further comprises a combination of both a tongue and groove running side by side for the length of said top edge;

c. positioning a first row of planar wall units on one side of said structural grid;

d. positioning a second row of planar wall units on an opposite side of said structural grid opposed to the first row of wall units;

e. providing a plurality of connecting brackets, said connecting brackets each having a medial span of approximately said width and opposing terminal ends each comprising double tongues sized to capture top and bottom edges of the opposing planar wall units, each medial span having a recess for selectively receiving and retaining a member of the structural grid, said double tongues having a top portion extending above said medial span and a bottom portion extending below said medial span, wherein the bottom portion of said double tongue is sized to capture the top edges of opposing planar wall units by fitting within groove portions of said tongue and groove combination whereupon the top portion of said double tongue of said connecting brackets is captured by the bottom groove of planar wall units of a subsequent course;

f. placing said plurality of connecting brackets through the structural grid and attaching said plurality of connecting brackets to members of the structural grid within said recesses of the medial spans, subsequently attaching said bottom portions of the double tongues of the connecting brackets to grooves running the length of said tongue and groove combinations on the top edges of opposing planar wall units of a first row thereof, said planar wall units being gauged from and supported by said structural grid during wall assembly, thereby completing a first course of planar wall units; and g. continuing to build subsequent courses of planar wall units upon lower courses by seating the bottom edge groove of subsequent wall units about or around the tongues of the top edges of the planar wall units and about or around the top portions of said connecting brackets of the course below until the courses are substantially of the predetermined length and height, whereby engagement of said connecting brackets to said structural grid members and opposing planar wall units creates a continuous internal void between the planar wall units through which the structural grid extends, thus enabling the placement and containment of structural or thermal insulating fill therein;

wherein step (a) is performed before steps (b) through (g).

2. The method of claim 1 wherein at least one side edge of said planar wall units also comprises said tongue and groove combination running the length of said side edge sized for capturing the tongues of connecting brackets and grooves of adjacent planar wall units.

3. The method of claim 1 wherein the bottom edge and one side edge of said planar wall units comprise a groove sized to capture a tongue of the connecting bracket and tongue of planar wall units of the course of wall units vertically below and horizontally to the side of adjacent planar wall units, facilitating planar wall unit to planar wall unit and connecting bracket to adjacent wall unit joining on both sides of the two-sided wall.

4. The method of claim 1 wherein the groove of said tongue and groove combination runs the entire length of said top edge of said planar wall units and is configured to capture the bottom tongue of connecting brackets at any location along said groove thereby enabling the connecting brackets to capture members of the structural grid and opposing planar wall units at any location along the edge of said planar wall units.

5. The method of claim 1 wherein malleable tabs are located within said recesses and wherein step (f) includes attaching said connecting brackets to members of the structural grid within said recesses of their medial spans whereupon said malleable tabs frictionally retain said structural grid members therein.

6. The method of claim 1 further comprising the step of introducing structural or thermally insulating fill material into the two-sided wall to substantially fill internal voids created by engaging the connecting brackets with the preinstalled structural grid and opposing planar wall units thereof.

7. The method of claim 1 wherein steps (b) through (g) are performed from one side of the structural grid.

8. The method of claim 1 wherein said connecting brackets further comprising opposing alignment plates, a first set of said alignment plates extending above and a second set of said alignment plates extending below said medial span of each connecting bracket, said first and second opposing alignment plates being secured by bridge plates also extending above and below said medial span and between opposing alignment plates, a first bridge plate extending above said medial span having opposing hooks that approximate the tops of first alignment plates and said second set of alignment plates having openings sized to receive the hooks of connecting brackets of the course below such that upon the placement of connecting brackets between planar wall units, said connecting brackets lock to one another so as to provide a course to course interlock in said two-sided wall assembly.

9. The method of claim 1 wherein said planar wall units are of multiple shapes and sizes which upon assembly create variable and non-uniform patterns on both sides of said two-sided wall.

10. The method of claim 9 wherein said planar wall units on a first side of said two-sided wall are of multiple shapes and sizes creating a variable pattern of such planar wall units, and planar wall units on a second side of the two-sided wall are of a single and uniform shape and size creating a repetitive and consistent pattern of planar wall units on said second side while remaining compatible with said brackets and structural grid.

11. The method of claim 1 wherein a starter assembly is provided for leveling and aligning a bottom course of wall units, said method comprising the steps of:

a. providing a plurality of substantially linear alignment channels sized to be captured by terminal end channels of starter brackets and sized to fit within a bottom groove of planar wall units constituting the first course of said two-sided wall;

b. positioning a first row of alignment channels on one side of said structural grid;

c. positioning a second row of alignment channels on the opposite side of said structural grid opposed the first row of alignment channels;

d. providing a plurality of said starter brackets, each starter bracket comprising a medial span between two terminal ends, each terminal end being sized to capture an alignment channel, the medial span of the starter bracket having penetrations for receiving masonry fasteners and a recess to facilitate adjustable placement around vertically extending reinforcing members;

e. placing a plurality of starter brackets on the surface of said concrete foundation footing as to capture a first alignment channel on a first side of the structural grid within a first terminal end;

f. passing said starter bracket through the structural grid and capturing a second and opposing alignment channel on a second side of said structural grid within a second terminal end of said starter bracket; and g. fastening said starter brackets to said structural concrete foundation footing at a predetermined position with masonry fasteners through said medial span penetrations thereby securing opposing alignment channels at said predetermined positions.

12. The method of claim 11 further comprising:

a. providing a plurality of substantially planar leveling shims of ascending thickness sized to be used as adjustable spacers between said alignment channels and structural concrete foundation footing; and b. positioning a plurality of said leveling shims as needed between the alignment channels and the surface of the structural concrete foundation footing for adjustment to the alignment channels and starter brackets for securing the starter assembly and subsequent planar wall unit courses at a level grade.

* * * * *